US011054762B2

(12) United States Patent
Takano et al.

(10) Patent No.: US 11,054,762 B2
(45) Date of Patent: Jul. 6, 2021

(54) POWDER CONTAINER, PROCESS CARTRIDGE, AND IMAGE FORMING APPARATUS

(71) Applicants: Kuniyori Takano, Tokyo (JP); Emi Kita, Kanagawa (JP); Hiroyoshi Haga, Kanagawa (JP); Yasuhide Ohkubo, Kanagawa (JP)

(72) Inventors: Kuniyori Takano, Tokyo (JP); Emi Kita, Kanagawa (JP); Hiroyoshi Haga, Kanagawa (JP); Yasuhide Ohkubo, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 203 days.

(21) Appl. No.: 16/316,523

(22) PCT Filed: Jul. 13, 2017

(86) PCT No.: PCT/JP2017/025628
§ 371 (c)(1),
(2) Date: Jan. 9, 2019

(87) PCT Pub. No.: WO2018/012608
PCT Pub. Date: Jan. 18, 2018

(65) Prior Publication Data

US 2020/0183301 A1 Jun. 11, 2020

(30) Foreign Application Priority Data

Jul. 14, 2016 (JP) ..... JP2016-139659
Jul. 28, 2016 (JP) ..... JP2016-148686
Jun. 9, 2017 (JP) ..... JP2017-113923

(51) Int. Cl.
*G03G 15/08* (2006.01)
*G03G 21/00* (2006.01)
(Continued)

(52) U.S. Cl.
CPC ..... *G03G 15/0865* (2013.01); *G03G 21/105* (2013.01); *G03G 21/1647* (2013.01)

(58) Field of Classification Search
CPC ..... G03G 15/0822; G03G 15/0865; G03G 15/0877; G03G 21/1647; G03G 21/10;
(Continued)

(56) References Cited

U.S. PATENT DOCUMENTS 5,262,824 A 11/1993 Morita et al.
5,634,172 A 5/1997 Manabe
(Continued)

FOREIGN PATENT DOCUMENTS

CN 1162775 A 10/1997
CN 102073242 A 5/2011
(Continued)

OTHER PUBLICATIONS

Japanese Office Action dated May 12, 2020 in Patent Application No. 2016-139659, 3 pages.
(Continued)

*Primary Examiner* — Sophia S Chen
(74) *Attorney, Agent, or Firm* — Oblon, McClelland, Maier & Neustadt, L.L.P.

(57) ABSTRACT

A powder container includes a collection port to receive and collect powder from outside; a driven unit that is disposed on one end side in a width direction of the powder container and to which drive is transmitted from outside; a first rotary shaft that rotates by the drive transmitted to the driven unit; a first gear disposed on other end side of the powder container and rotating with the first rotary shaft; a second rotary shaft that is disposed on the other end side, that includes a second gear to which drive is transmitted from the first gear, and that rotates with the second gear; and a driving gear that is disposed on the second rotary shaft in a position between the
(Continued)

second gear and a central portion in the width direction of the powder container, and that rotates with the second rotary shaft to transmit drive to outside.

28 Claims, 10 Drawing Sheets

(51) Int. Cl.
*G03G 21/16* (2006.01)
*G03G 21/10* (2006.01)

(58) Field of Classification Search
CPC .. G03G 21/105; G03G 21/12; G03G 21/1821; G03G 2215/0827; G03G 2221/1657
See application file for complete search history.

(56) References Cited

U.S. PATENT DOCUMENTS

| | | | | |
|---|---|---|---|---|
| 8,571,447 | B2 | 10/2013 | Eto | |
| 9,465,329 | B2 * | 10/2016 | Okazaki | G03G 15/161 |
| 2007/0104523 | A1 * | 5/2007 | Yoshida | G03G 21/105 399/358 |
| 2008/0226333 | A1 | 9/2008 | Ono et al. | |
| 2009/0087223 | A1 | 4/2009 | Yabuki | |
| 2012/0128391 | A1 | 5/2012 | Ushikubo | |
| 2013/0136465 | A1 | 5/2013 | Yoshida et al. | |
| 2013/0259495 | A1 * | 10/2013 | Ota | G03G 21/105 399/35 |
| 2014/0319764 | A1 | 10/2014 | Saito | |
| 2015/0132018 | A1 | 5/2015 | Sakaya et al. | |
| 2015/0132026 | A1 | 5/2015 | Yoshida et al. | |
| 2015/0286163 | A1 | 10/2015 | Yoshida et al. | |
| 2015/0346638 | A1 | 12/2015 | Mizusawa et al. | |
| 2016/0026119 | A1 * | 1/2016 | Ohashi | G03G 21/10 399/358 |
| 2016/0091828 | A1 | 3/2016 | Okazaki et al. | |
| 2016/0109827 | A1 | 4/2016 | Yoshida et al. | |
| 2017/0285568 | A1 * | 10/2017 | Nishiyama | G03G 21/12 |

FOREIGN PATENT DOCUMENTS

| | | | |
|---|---|---|---|
| CN | 102955400 | A | 3/2013 |
| CN | 105467804 | A | 4/2016 |
| JP | 9-212055 | A | 8/1997 |
| JP | 11-84969 | A | 3/1999 |
| JP | 2000-356937 | A | 12/2000 |
| JP | 2002-49287 | A | 2/2002 |
| JP | 2005-338583 | A | 12/2005 |
| JP | 2006-154259 | A | 6/2006 |
| JP | 2008-52033 | A | 3/2008 |
| JP | 2008-76887 | A | 4/2008 |
| JP | 2008-225118 | A | 9/2008 |
| JP | 2009008817 | A | 1/2009 |
| JP | 2009-80433 | A | 4/2009 |
| JP | 2011-13303 | A | 1/2011 |
| JP | 2011-158507 | A | 8/2011 |
| JP | 2012-208167 | A | 10/2012 |
| JP | 5386467 | B2 | 10/2013 |
| JP | 5538284 | B2 | 7/2014 |
| JP | 2014-232270 | A | 12/2014 |
| JP | 2015-31865 | A | 2/2015 |
| JP | 2016-71214 | A | 5/2016 |
| SU | 2 533 927 | C1 | 11/2014 |

OTHER PUBLICATIONS

International Search Report and Written Opinion dated Sep. 26, 2017 in PCT/JP2017/025628 filed on Jul. 13, 2017.
International Preliminary Report on Patentability dated Oct. 17, 2018 in PCT/JP2017/025628 filed on Jul. 13, 2017.
Written Opinion of the International Preliminary Examining Authority dated Jun. 12, 2018 in PCT/JP2017/025628 filed on Jul. 13, 2017.
Combined Russian Decision to Grant of a Patent and Search Report dated Sep. 26, 2019 in Patent Application No. 2019103853 (with English translation), 27 pages.
Korean Office Action dated Oct. 23, 2019 in Korean Patent Application No. 10-2019-7003133 (with English translation), 7 pages.
Extended European Search Report dated Jun. 26, 2019 in European Patent Application No. 17827731.5, 9 pages.
Japanese Office Action dated May 29, 2020 in Japanese Patent Application No. 2016-148686, 5 pages.
Combined Chinese Office Action and Search Report dated Jan. 5, 2021 in corresponding Chinese Patent Application No. 201780054352.7 (with English Translation of Category of Cited Documents), 6 pages.
Japanese Office Action dated Nov. 6, 2020 in Japanese Patent Application No. 2016-148686, 5 pages.
Japanese Office Action dated Nov. 25, 2020 in Japanese Patent Application No. 2017-113923 (with English translation), 7 pages.
Notice of Allowance dated Apr. 19, 2021 in corresponding Korean Application No. 10-2021-7002457, 4 pages.

* cited by examiner

[Fig. 1]
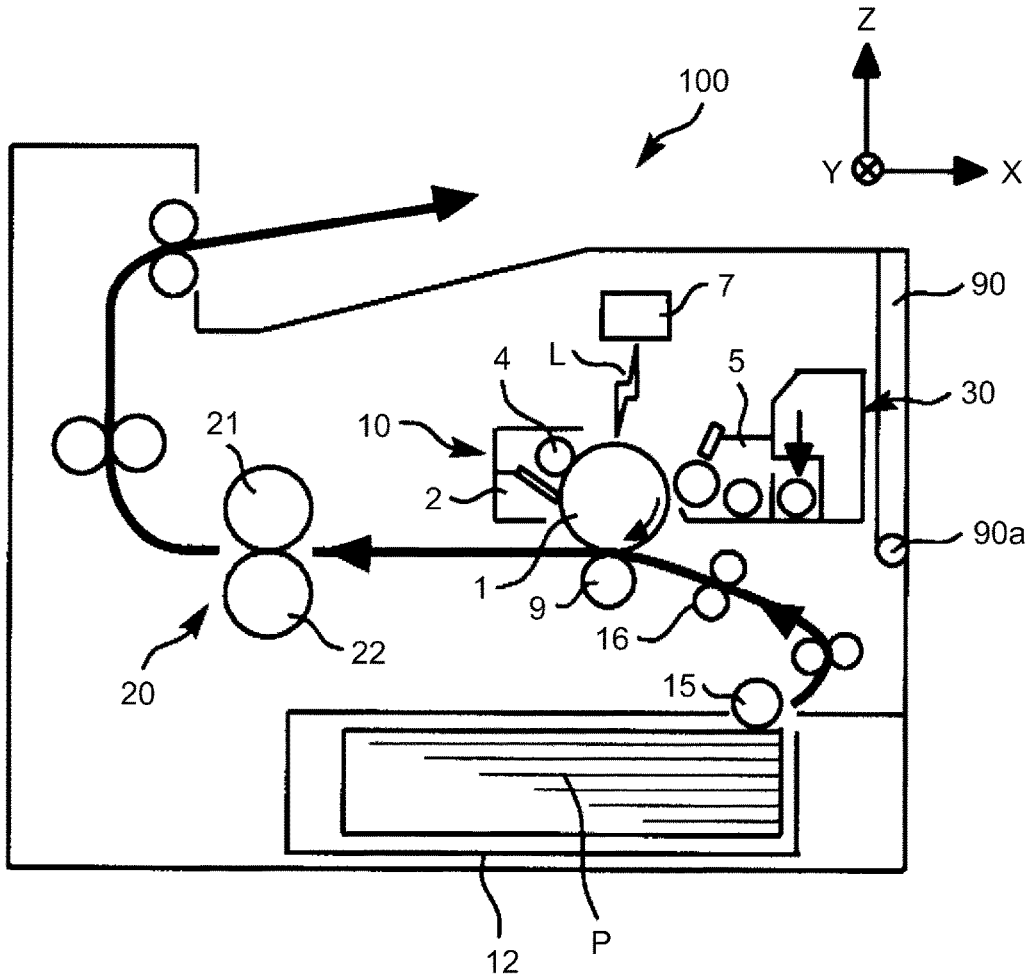
[Fig. 2]
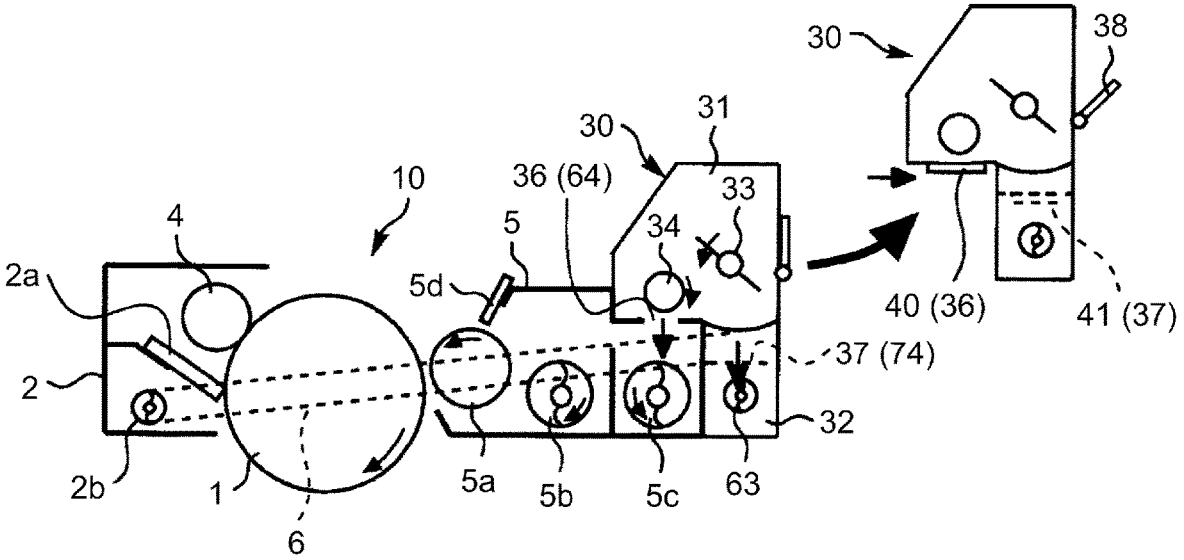

[Fig. 3A]
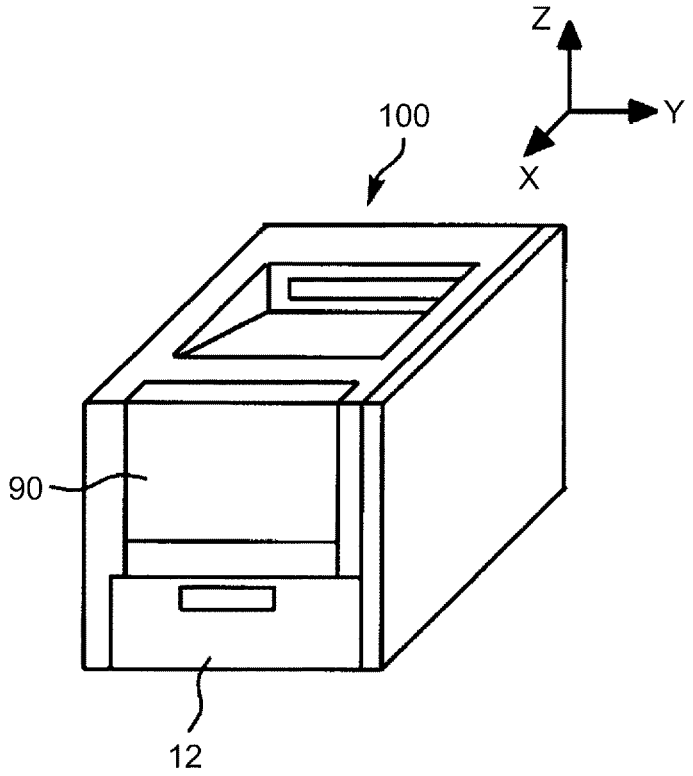
[Fig. 3B]
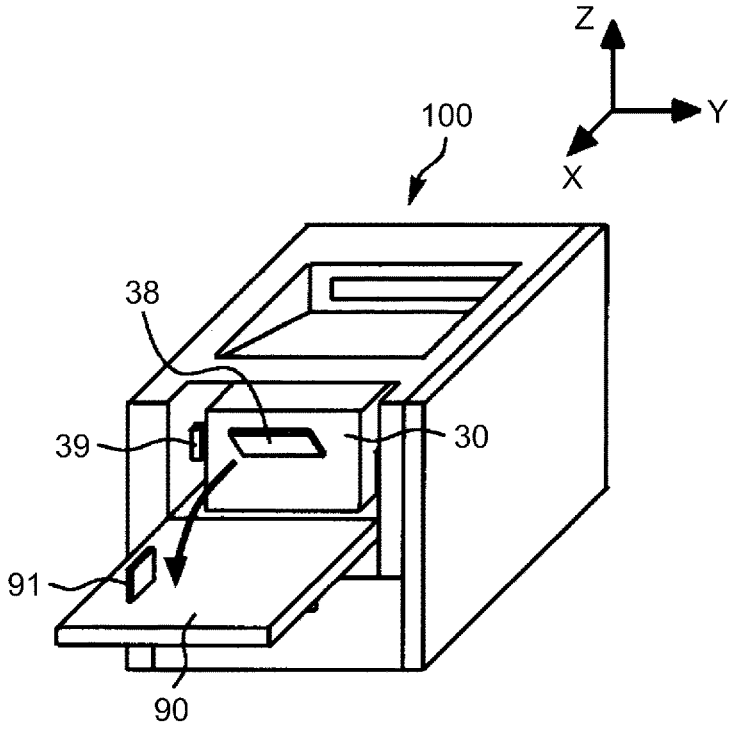

[Fig. 4]
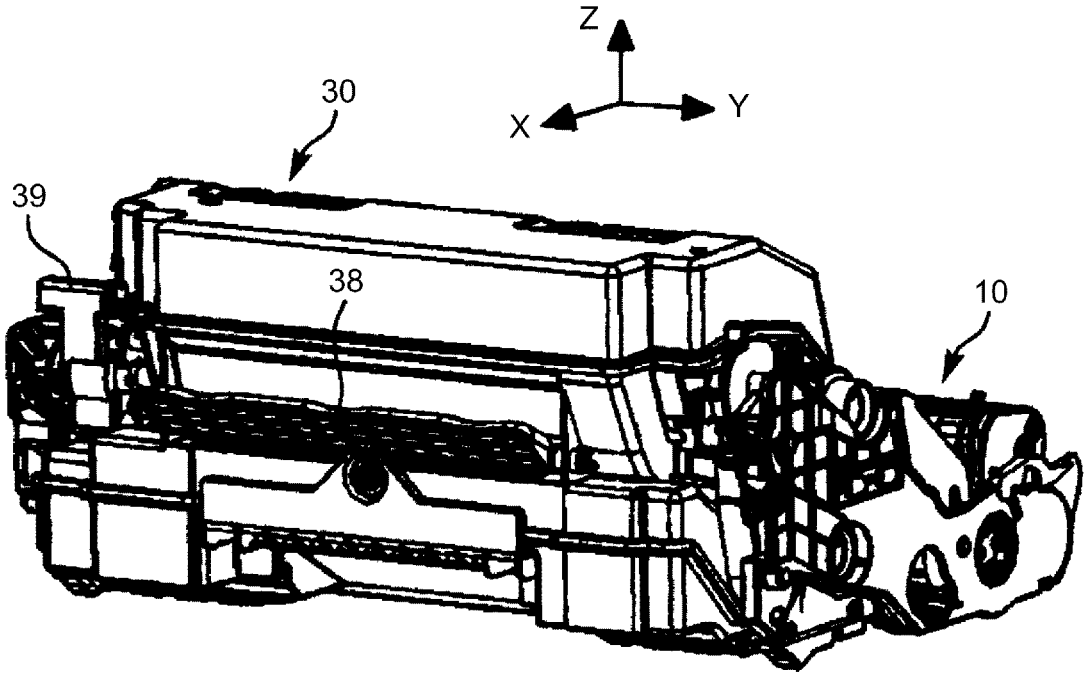
[Fig. 5]
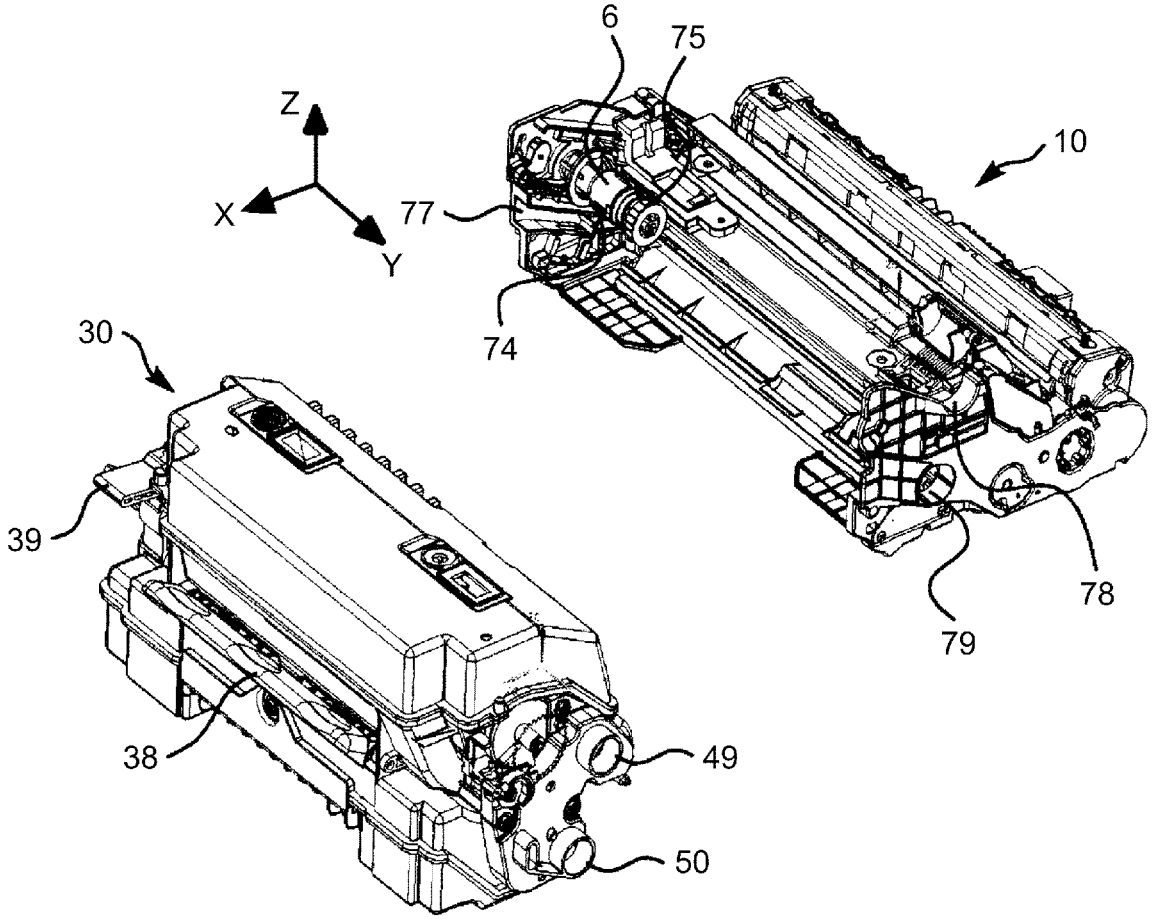

[Fig. 6]
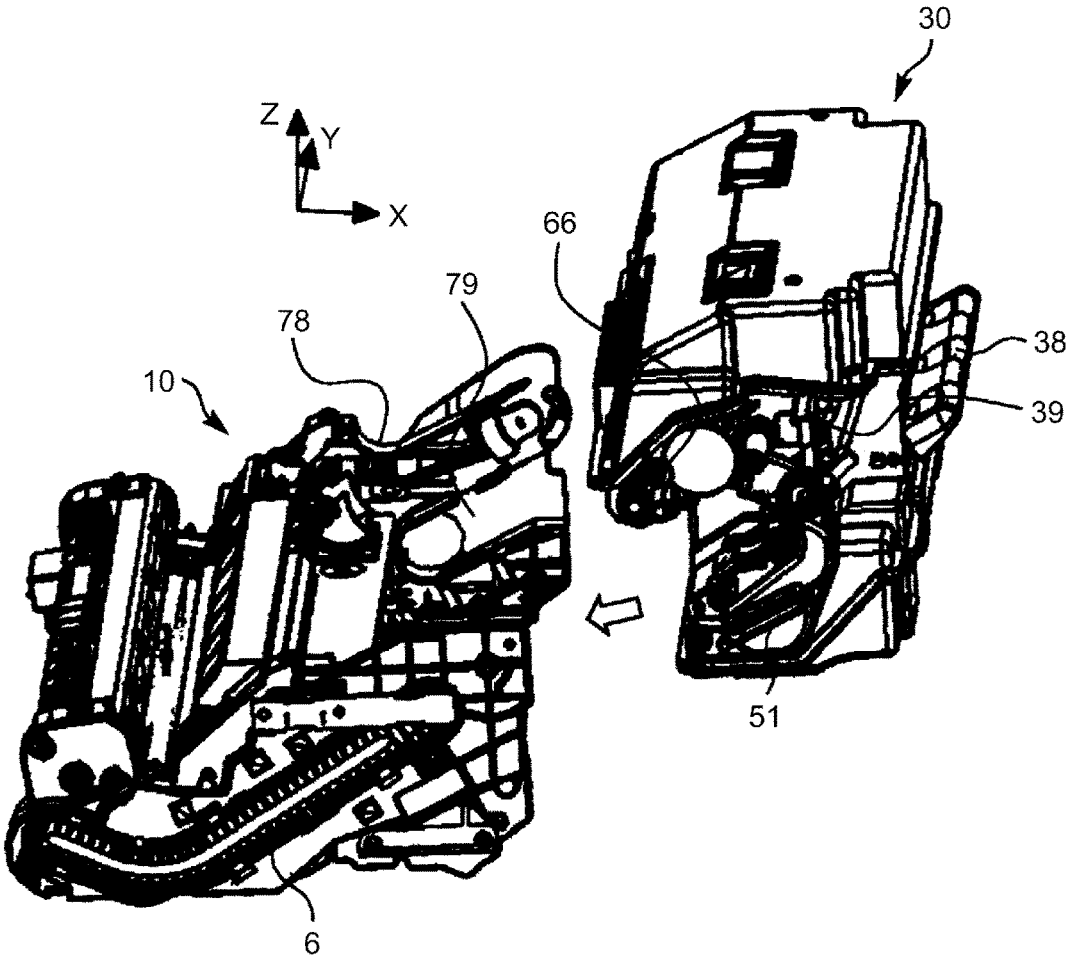
[Fig. 7]
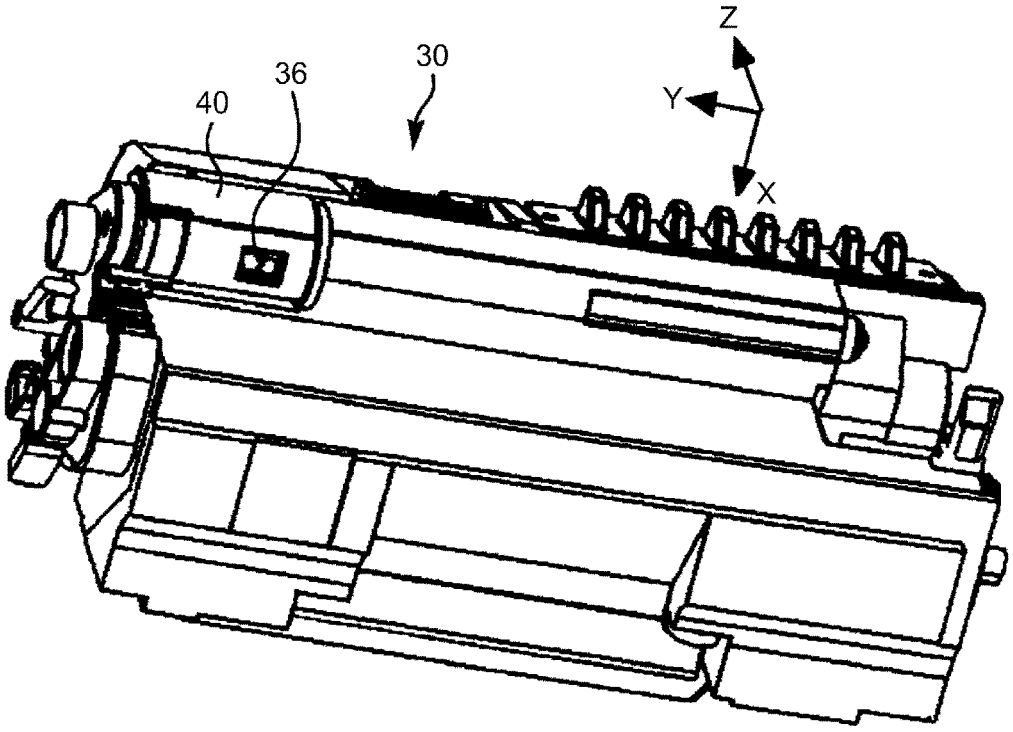

[Fig. 8]
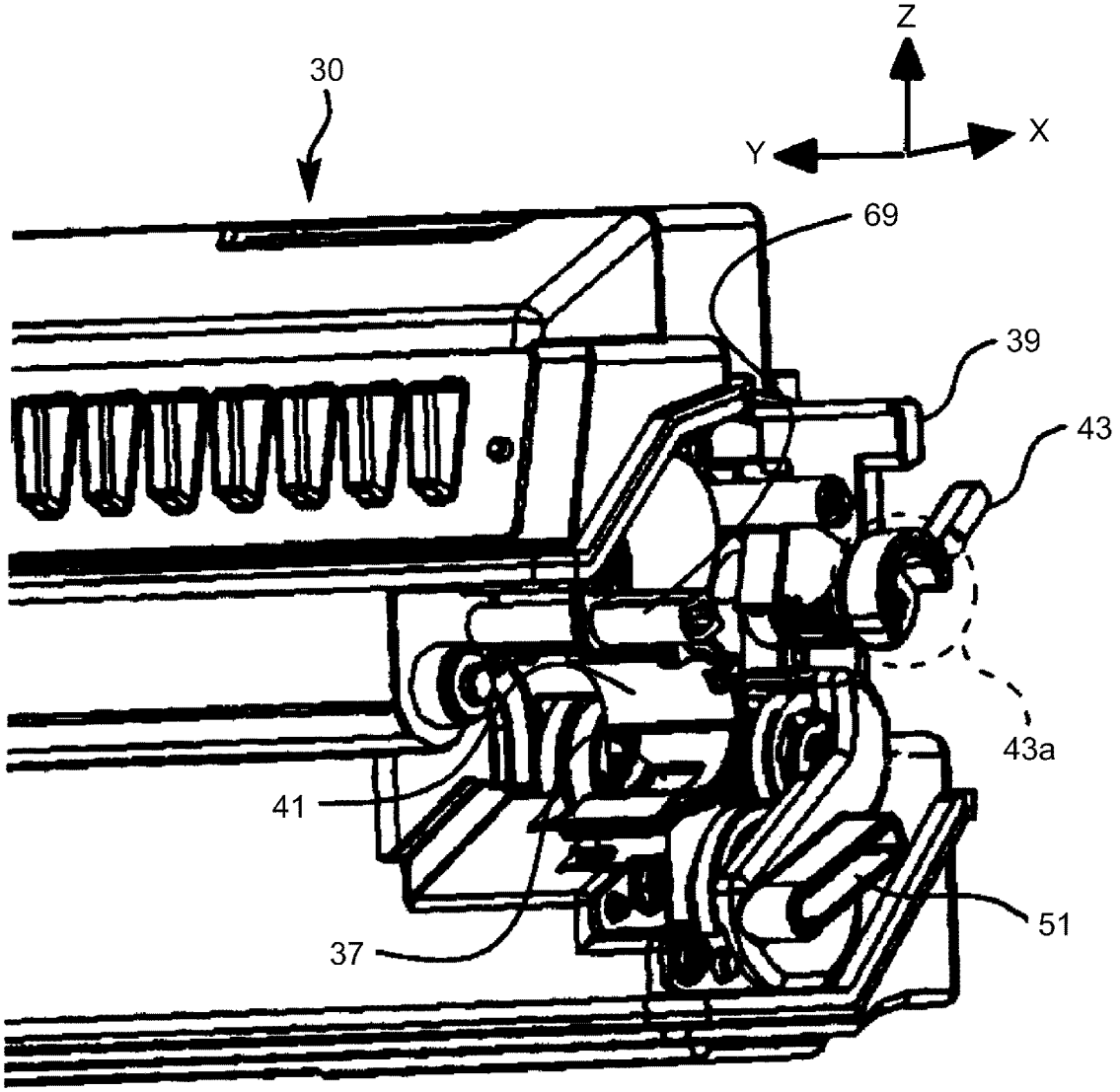

[Fig. 9]
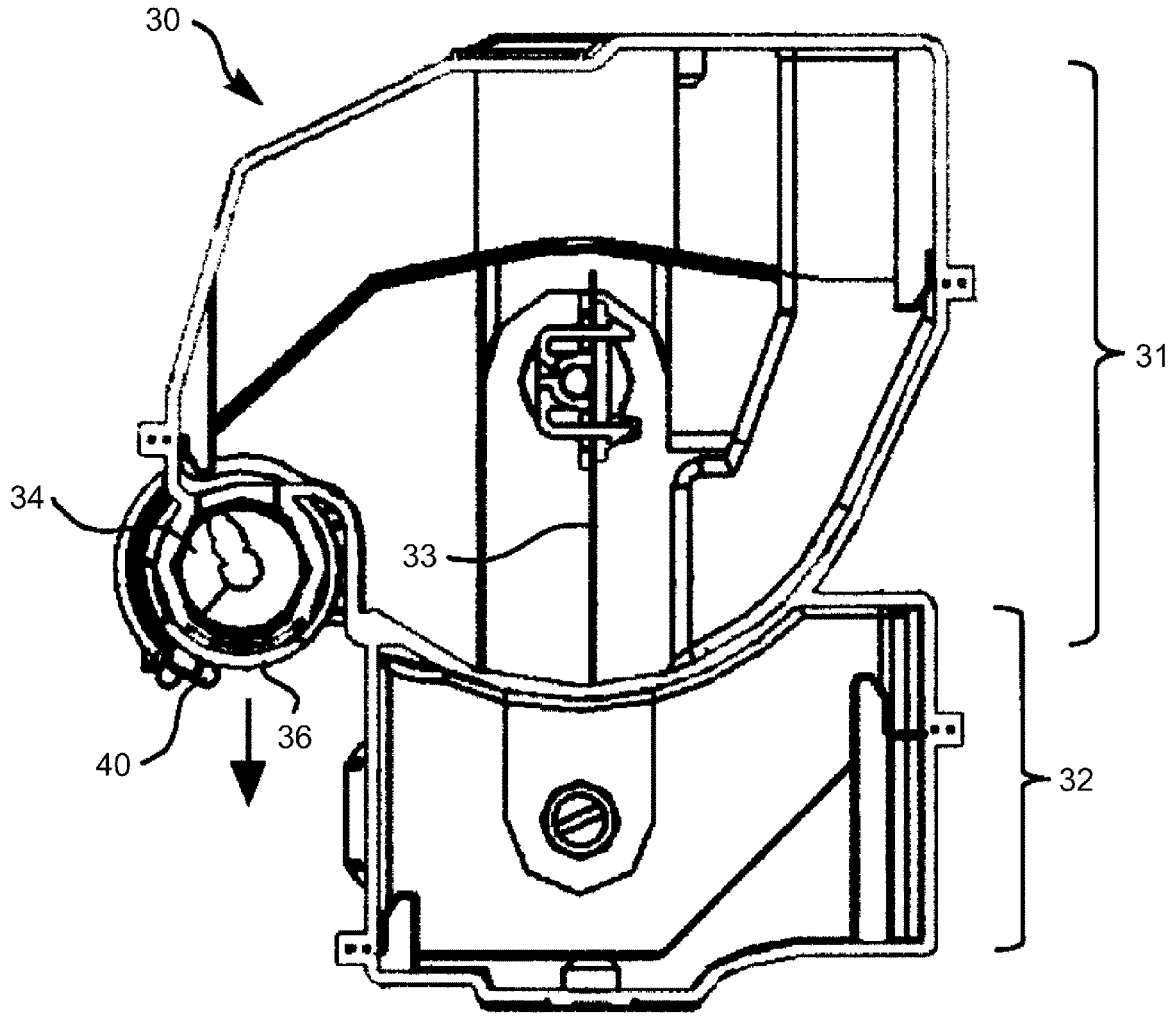

[Fig. 10]
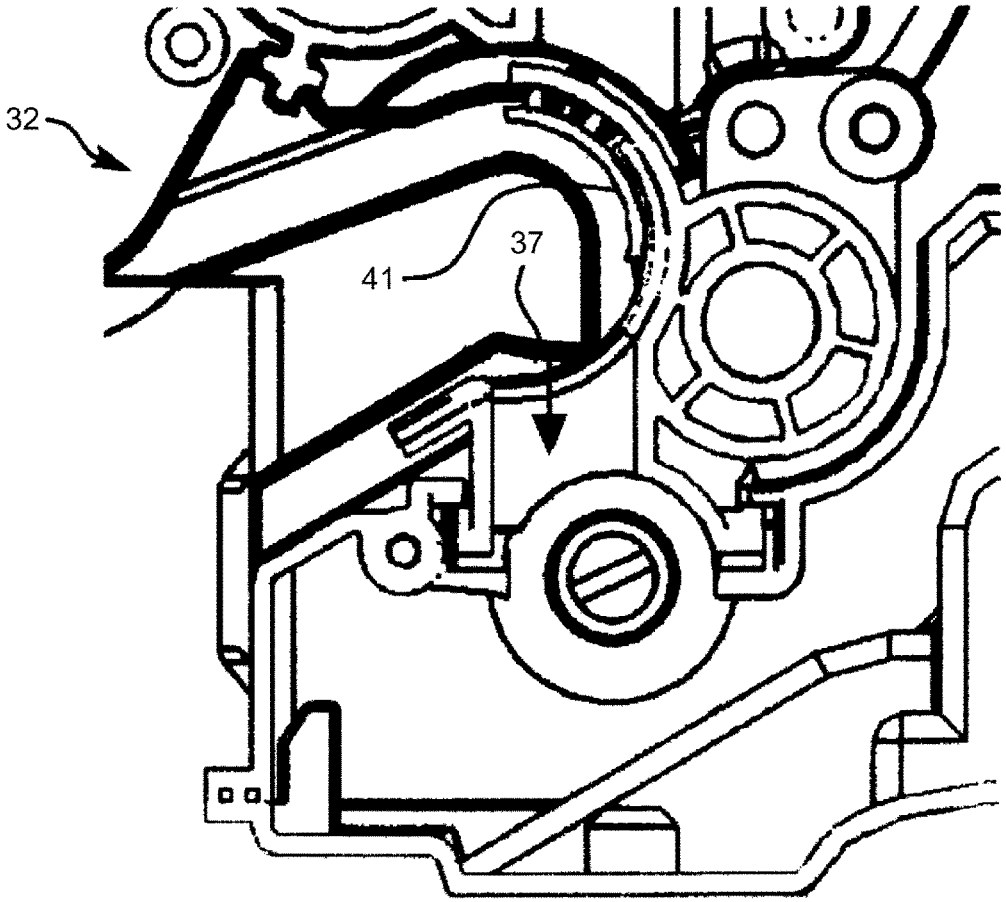
[Fig. 11]
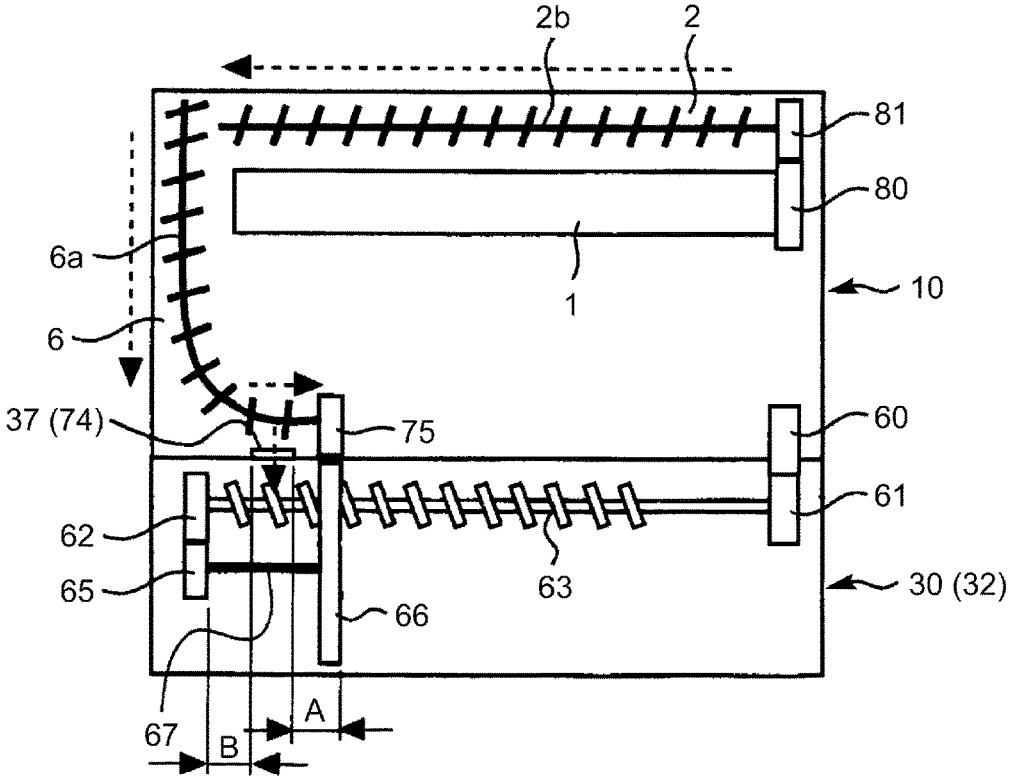

[Fig. 12]
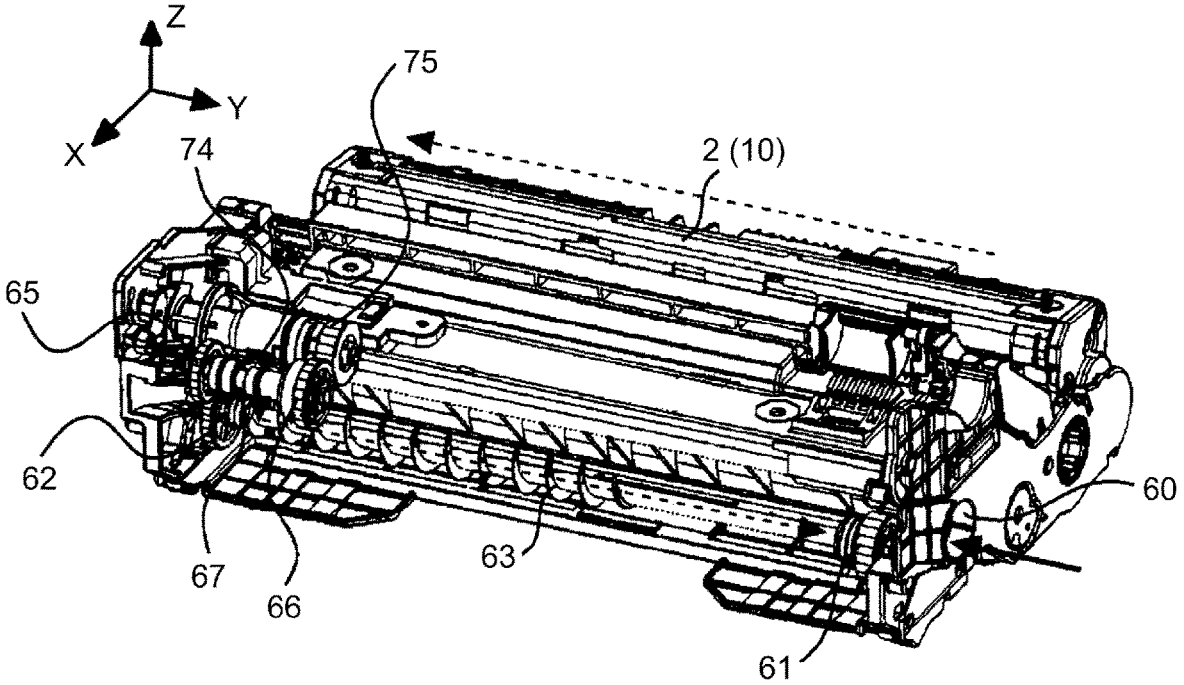
[Fig. 13]
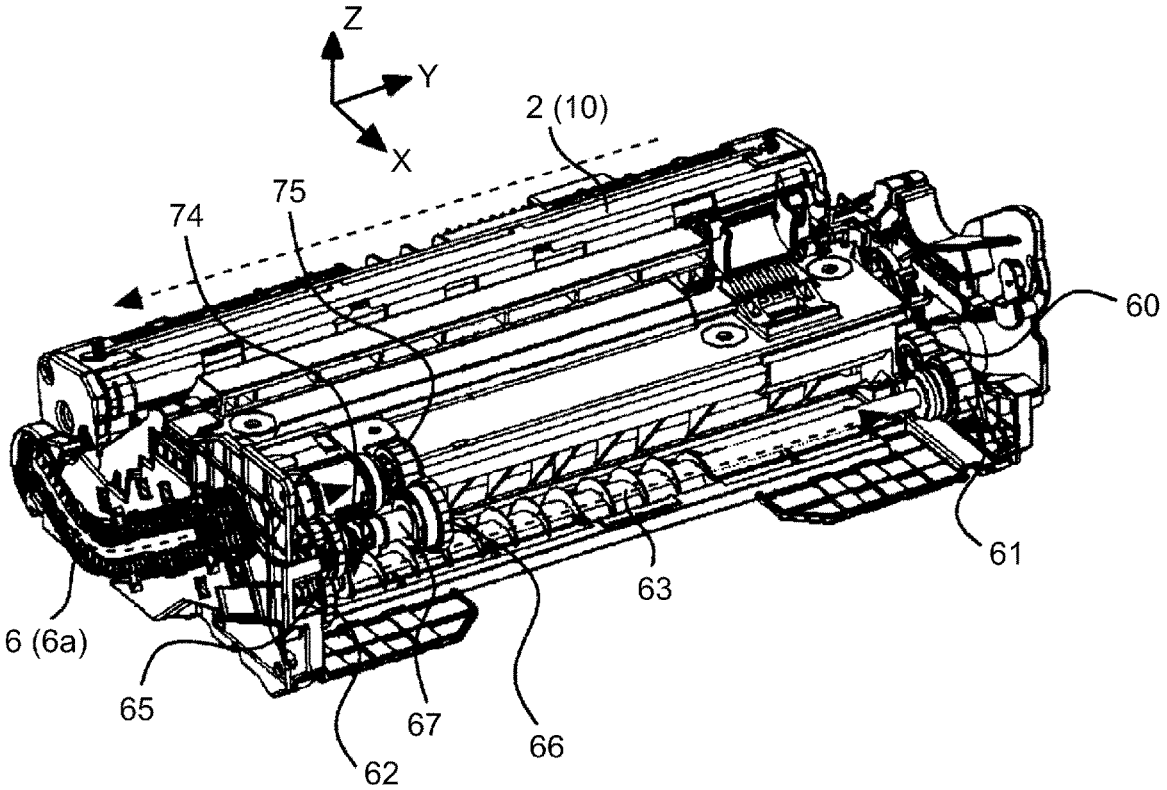

[Fig. 14]
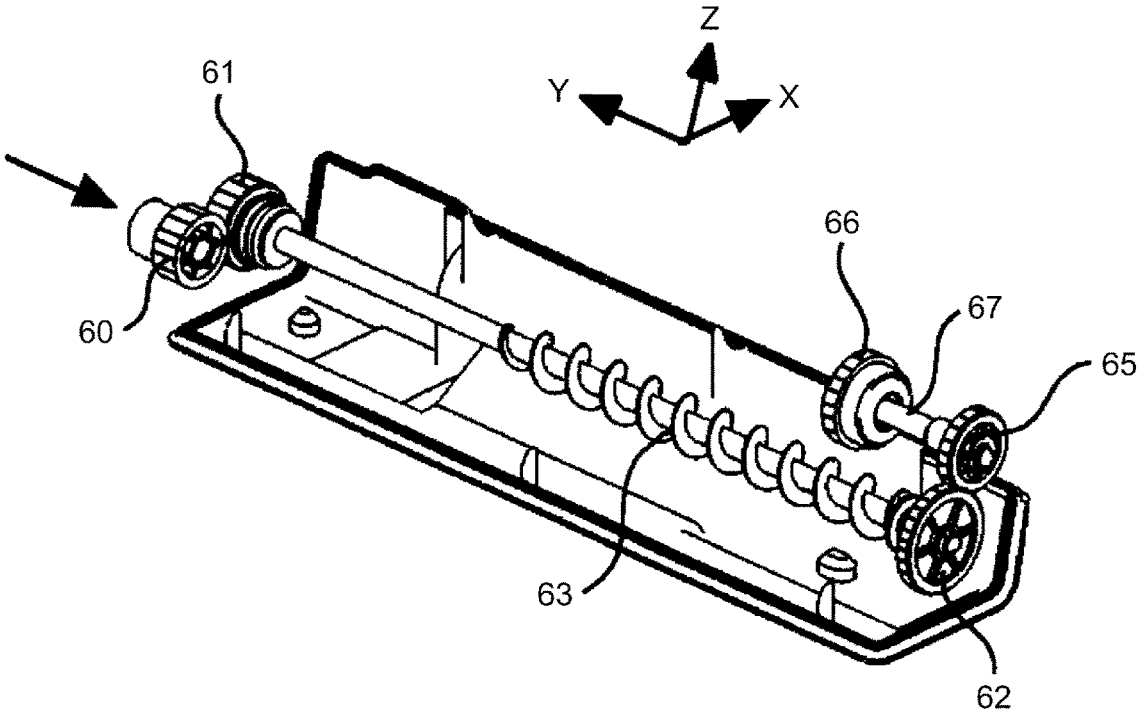
[Fig. 15]
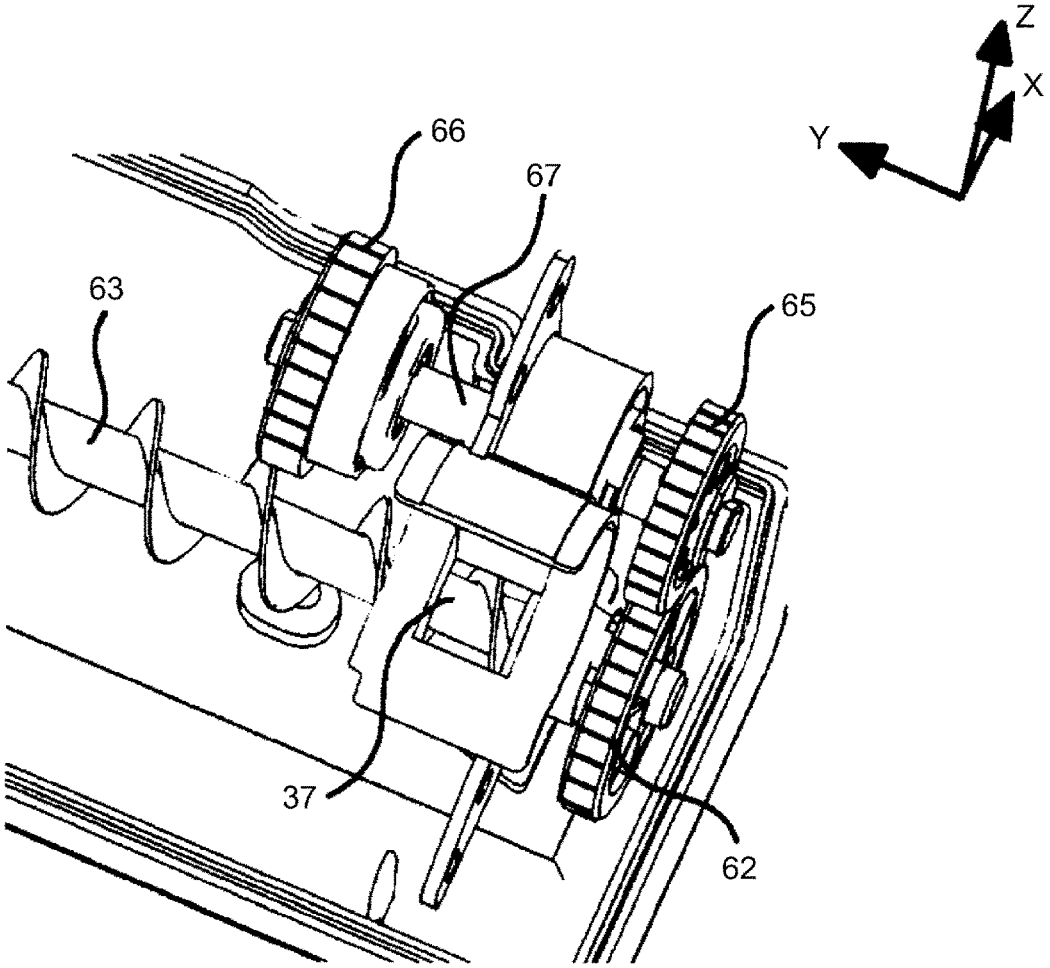

[Fig. 16A]
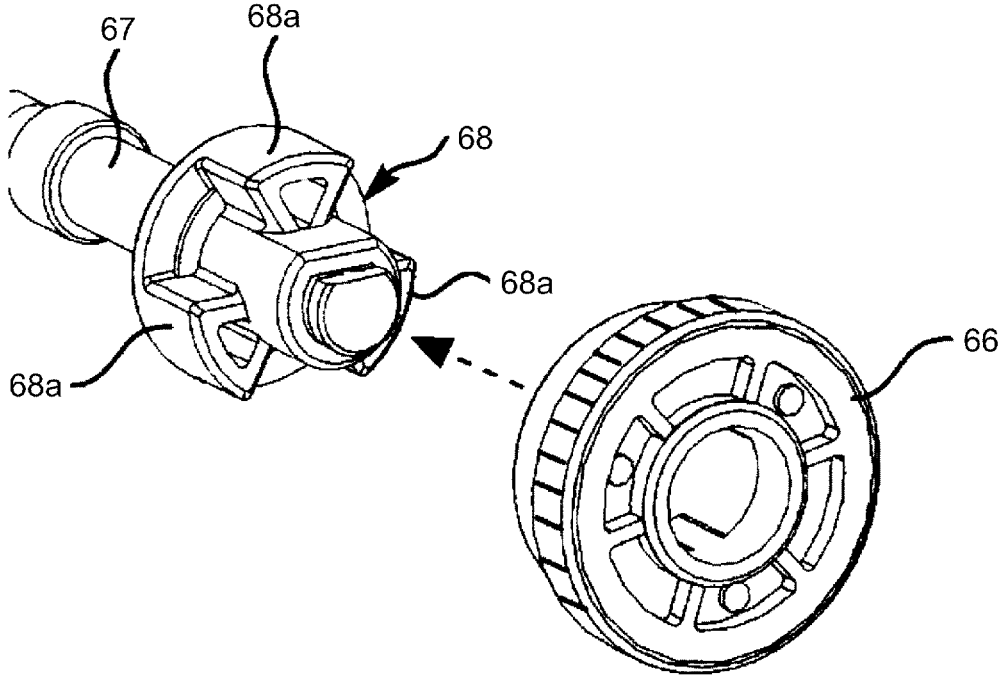
[Fig. 16B]
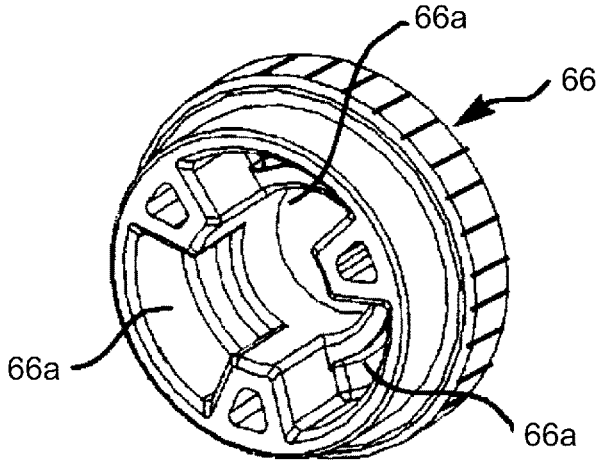

POWDER CONTAINER, PROCESS CARTRIDGE, AND IMAGE FORMING APPARATUS

TECHNICAL FIELD

The present invention relates to a powder container removably mounted in a main body of an image forming apparatus or a process cartridge, and relates to a process cartridge and an image forming apparatus each including the powder container.

BACKGROUND ART

Conventionally, there is a known image forming apparatus, such as a copier, a printer, or a facsimile machine, in which a powder container (a developer container) for collecting and storing powder, such as waste toner, is removably mounted in the main body of the image forming apparatus (or a process cartridge) (see, for example, PTL 1).

Specifically, untransferred toner collected by a cleaning device mounted in the main body of the image forming apparatus is conveyed by a waste toner conveying unit (a conveying pipe) and then collected as waste toner in the powder container from a collection port. When the powder container is filled with the collected waste toner, the powder container is removed from the main body of the image forming apparatus and replaced with a new powder container (or a powder container subjected to maintenance).

SUMMARY OF INVENTION

Technical Problem

In the conventional powder container, if a driven unit (a drive input unit) for driving a conveying screw or the like that conveys powder (waste toner) collected in the powder container is to be disposed together with a driving gear (a drive output unit) for transmitting drive to the waste toner conveying unit or the like mounted in the main body of the image forming apparatus by using a driving force of the driven unit, it is difficult to arrange both of the driven unit (the drive input unit) and the driving gear (the drive output unit) on one end side in the width direction of the powder container for layout reasons. Therefore, one of the driven unit and the driving gear is arranged on one end side in the width direction and the other is arranged on the other end side in the width direction.

However, if one of the driven unit and the driving gear is arranged on one end side in the width direction and the other is arranged on the other end side in the width direction as described above, the size of the powder container in the width direction increases.

The present invention has been made to solve the problem as described above, and an object is to provide a powder container, a process cartridge, and an image forming apparatus in which a driven unit serving as a drive input unit and a driving gear serving as a drive output unit can be provided without much increase in the size of the powder container.

Solution to Problem

According to an aspect of the present invention, a powder container is removably mounted in one of a main body of an image forming apparatus and a removable member that is removably mounted in the main body of the image forming apparatus. The powder container includes a collection port to receive and collect powder from outside; a driven unit that is disposed on one end side in a width direction of the powder container and to which drive is transmitted from outside; a first rotary shaft that rotates by using the drive transmitted to the driven unit; a first gear that is disposed on other end side in the width direction of the powder container and that rotates with the first rotary shaft; a second rotary shaft that is disposed on the other end side in the width direction of the powder container, that includes a second gear to which drive is transmitted from the first gear, and that rotates with the second gear; and a driving gear that is disposed on the second rotary shaft in a position between the second gear and a central portion in the width direction of the powder container, and that rotates with the second rotary shaft to transmit drive to outside.

Advantageous Effects of Invention

According to an embodiment of the present invention, it is possible to provide a powder container, a process cartridge, and an image forming apparatus capable of a driven unit serving as a drive input unit and a driving gear serving as a drive output unit can be provided without much increase in the size of the powder container.

BRIEF DESCRIPTION OF DRAWINGS

FIG. 1 is an overall configuration diagram illustrating an image forming apparatus according to an embodiment of the present invention.

FIG. 2 is a schematic diagram illustrating a process cartridge and a toner container.

FIG. 3A is a perspective view illustrating the image forming apparatus.

FIG. 3B is a perspective view illustrating the image forming apparatus in which an open/close cover is opened.

FIG. 4 is a perspective view illustrating a state in which the toner container is attached to the process cartridge.

FIG. 5 is a perspective view illustrating a state in which the toner container is separated from the process cartridge.

FIG. 6 is a perspective view illustrating a state in which the toner container is to be attached to the process cartridge.

FIG. 7 is a perspective view illustrating the toner container viewed from below.

FIG. 8 is a perspective view illustrating a portion near a collection port of the toner container from which a gear train is removed.

FIG. 9 is a diagram illustrating the inside of the toner container.

FIG. 10 is a diagram illustrating a toner collecting unit in the toner container.

FIG. 11 is a schematic diagram illustrating a waste toner conveying path in the process cartridge and the toner container.

FIG. 12 is a perspective view illustrating the inside of a waste toner collecting unit in the toner container attached to the process cartridge.

FIG. 13 is a perspective view illustrating the inside of the waste toner collecting unit in the toner container attached to the process cartridge and the inside of the waste toner conveying unit.

FIG. 14 is a perspective view illustrating main components in the waste toner collecting unit of the toner container.

FIG. 15 is an enlarged perspective view illustrating a main part in the waste toner collecting unit of the toner container.

FIG. 16A is a perspective view illustrating a state in which a driving gear is separated from a second rotary shaft.

FIG. 16B is a perspective view of the driving gear viewed from the second rotary shaft side.

DESCRIPTION OF EMBODIMENTS

Exemplary embodiments of the present invention will be described in detail below with reference to the accompanying drawings. In the drawings, the same or equivalent components are denoted by the same symbols, and the same explanation will appropriately be simplified or omitted.

First, with reference to FIG. 1, an overall configuration and operations of an image forming apparatus 100 will be described.

In FIG. 1, a printer 100 as the image forming apparatus includes a photoconductor drum 1 with a surface on which a toner image is formed, and an exposing unit (a writing unit) 7 that emits exposure light L based on image information input from an input device, such as a personal computer, onto the photoconductor drum 1.

Furthermore, the printer 100 includes a transfer roller 9 that transfers the toner image bore on the surface of the photoconductor drum 1 onto a sheet P conveyed to a transfer nip portion (a transfer position), a process cartridge 10 in which the photoconductor drum 1, a charging roller 4, a developing device 5, a cleaning device 2, and a waste toner conveying unit 6 are integrated, and a sheet feed device (a sheet cassette) 12 in which sheets P, such as paper, are stored.

Moreover, the printer 100 includes a registration roller (a timing roller) 16 that conveys the sheet P toward the transfer nip portion at which the photoconductor drum 1 and the transfer roller 9 come in contact with each other, a fixing device 20 that fixes an unfixed image on the sheet P, a fixing roller 21 mounted in the fixing device 20, a pressurizing roller 22 mounted in the fixing device 20, and a toner container 30 as a powder container.

The charging roller 4, the developing device 5, the cleaning device 2, the waste toner conveying unit 6, and the like are arranged around the photoconductor drum 1. These components (the photoconductor drum 1, the charging roller 4, the developing device 5, the cleaning device 2, and the waste toner conveying unit 6) are integrated as the process cartridge 10 (a removable member, a removable device, or a removable unit), and removably (replaceably) mounted in the main body of the image forming apparatus 100. The process cartridge 10 is replaced with a new one in a constant replacement cycle.

Furthermore, the toner container 30 as the powder container is removably (replaceably) mounted in the main body of the image forming apparatus 100 on the upper side of the process cartridge 10 (the developing device 5). Toner (new toner) as powder is stored inside the toner container 30 (a toner storage 31). The toner is appropriately supplied from the toner container 30 to the inside of the developing device 5. If the toner container 30 becomes empty of the toner stored therein (or the developing device 5 becomes empty of the toner stored therein), the toner container 30 is replaced with a new one. The toner container 30 according to the embodiment also includes a waste toner collecting unit 32 (a powder collecting unit) that collects waste toner as powder, in addition to the toner storage 31 (a powder storage) in which new toner is stored, which will be described in detail later.

With reference to FIG. 1 and FIG. 2, a normal operation of forming an image in the image forming apparatus 100 will be described.

With reference to FIG. 1, firstly, when an input device, such as a personal computer, transmits image information to the exposing unit 7 of the image forming apparatus 100, the exposing unit 7 emits exposure light L (laser light) based on the image information toward the surface of the photoconductor drum 1.

Meanwhile, the photoconductor drum 1 rotates in the direction of arrow (in the clockwise direction). The surface of the photoconductor drum 1 is uniformly charged in a position facing the charging roller 4 (a charging process). Accordingly, a charging potential (about −900 volts (V)) is formed on the photoconductor drum 1. Subsequently, the charged surface of the photoconductor drum 1 reaches a position of irradiation of the exposure light L. Then, the potential of a portion irradiated with the exposure light L reaches a latent image potential (about 0 to −100 volts (V)), so that an electrostatic latent image is formed on the surface of the photoconductor drum 1 (an exposure process).

Subsequently, the surface of the photoconductor drum 1 on which the electrostatic latent image is formed reaches a position facing the developing device 5. The developing device 5 supplies toner onto the photoconductor drum 1, so that the latent image on the photoconductor drum 1 is developed and a toner image is formed (a developing process).

As illustrated in FIG. 2, the developing device 5 includes a developing roller 5*a*, two developing conveying screws 5*b* and 5*c*, a doctor blade 5*d*, and the like. Developer (two-component developer) formed of toner and carrier is stored in the developing device 5. Furthermore, toner is supplied from a discharge port 36 of the toner container 30 (the toner storage 31) to the inside of the developing device 5 through an inflow port 64 of the developing device 5 in accordance with the consumption of toner in the developer inside the developing device 5. The supplied toner is cyclically conveyed by the developing conveying screws 5*b* and 5*c* in the longitudinal direction (the vertical direction with respect to the sheet of paper of FIG. 2) while being stirred with the developer. Subsequently, a part of the developer conveyed by the developing conveying screw 5*b*, which is one of the screws, is scooped up by the developing roller 5*a*, the amount of the developer scooped up by the developing roller 5*a* is optimized by the doctor blade 5*d*, and the developer reaches a position facing the photoconductor drum 1 (a developing area). In the developing area, toner in the optimized amount of developer adheres to the electrostatic latent image on the photoconductor drum 1, so that a toner image is formed on the photoconductor drum 1. The developing roller 5*a* and the two developing conveying screws 5*b* and 5*c* are driven to rotate in the directions of arrows in FIG. 2 by receiving drive from a driving motor mounted in the main body of the image forming apparatus 100.

Thereafter, the surface of the photoconductor drum 1 subjected to the developing process reaches the transfer nip portion (the transfer position) formed with the transfer roller 9. At the transfer nip portion formed with the transfer roller 9, a power supply unit applies a transfer bias (a bias with the polarity opposite to the polarity of the toner) to the transfer roller 9, so that the toner image formed on the photoconductor drum 1 is transferred onto the sheet P conveyed by the registration roller 16 (a transfer process).

Subsequently, the surface of the photoconductor drum 1 subjected to the transfer process reaches a position facing the cleaning device 2. At this position, untransferred toner remaining on the photoconductor drum 1 is mechanically removed by a cleaning blade 2*a*, and is collected in the cleaning device 2 (a cleaning process).

Thus, a series of image formation processes on the photoconductor drum 1 is completed.

The untransferred toner collected in the cleaning device 2 is conveyed to one end side in the width direction (a rotation axis direction) by a collecting screw 2*b* mounted in the cleaning device 2, is conveyed to an oblique upper right side in FIG. 2 by the waste toner conveying unit 6 (in which a waste toner conveying coil 6*a* is mounted), and is collected as waste toner in the toner container 30 (the waste toner collecting unit 32) from an outflow port 74 of the waste toner conveying unit 6 via a collection port 37 of the toner container 30.

In the new toner container 30, the toner storage 31 is filled with new toner and the waste toner collecting unit 32 is empty.

Meanwhile, the sheet P conveyed to the transfer nip portion (the transfer position) between the photoconductor drum 1 and the transfer roller 9 is handled as described below.

Firstly, the topmost one of the sheets P stored in the sheet feed device 12 is fed toward a conveying path by a paper feeding roller 15.

Subsequently, the sheet P reaches a position of the registration roller 16. The sheet P that has reached the position of the registration roller 16 is conveyed toward the transfer nip portion (a contact position of the transfer roller 9 and the photoconductor drum 1) at a synchronized timing for position alignment with respect to the image formed on the photoconductor drum 1.

The sheet P subjected to the transfer process passes through the position of the transfer nip portion (the transfer roller 9), and reaches the fixing device 20 through the conveying path. The sheet P that has reached the fixing device 20 is fed between the fixing roller 21 and the pressurizing roller 22, and the image is fixed due to heat applied from the fixing roller 21 and pressure applied from both of the fixing roller 21 and the pressurizing roller 22. The sheet P with the fixed image is output from a nip (a fixing nip portion) between the fixing roller 21 and the pressurizing roller 22, is discharged from the main body of the image forming apparatus 100, and is placed on a discharge tray.

Thus, a series of image formation processes is completed.

The image forming apparatus 100 according to the embodiment is covered with a plurality of external covers as illustrated in FIG. 3A. Furthermore, as illustrated in FIG. 3B, a part of the external cover on the front side is configured as an open/close cover 90 disposed in a rotatable manner.

Specifically, the open/close cover 90 is held by the main body of the image forming apparatus 100 so as to be rotatable about a spindle 90*a* (a central axis of rotation). The open/close cover 90 shifts to a closed state (a state illustrated in FIG. 1 and FIG. 3A) by rotating in the counterclockwise direction in FIG. 1 about the spindle 90*a*, and shifts to an open state (a state illustrated in FIG. 3B) by rotating in the clockwise direction in FIG. 1 about the spindle 90*a*.

In the embodiment, as illustrated in FIG. 3B, the toner container 30 (the powder container) is configured to be exposed so that the toner container 30 can be attached to and detached from the main body of the image forming apparatus 100 while the open/close cover 90 is in the open state. While the open/close cover 90 is opened, only the toner container 30 (in the state illustrated in FIG. 7) is replaced with a new one, or the toner container 30 and the process cartridge 10 (in the state illustrated in FIG. 4) are simultaneously replaced with new ones.

Furthermore, as illustrated in FIG. 1, the image formation process (a printing operation) described above with reference to FIG. 1 is performed while the open/close cover 90 is closed.

Characteristic configurations and operations of the toner container 30 (the powder container) in the embodiment will be described in detail below.

As illustrated in FIG. 2, in the embodiment, the toner container 30 as the powder container is configured to be removably mounted in the process cartridge 10. In particular, in the embodiment, the toner container 30 is able to be attached to and detached from the process cartridge 10 both in the state where the process cartridge 10 is attached to the image forming apparatus 100 and in the state where the process cartridge 10 is detached from the image forming apparatus 100.

As described above with reference to FIG. 3 for example, in the embodiment, the toner container 30 is removably mounted in the main body of the image forming apparatus 100 to which the process cartridge 10 is attached. Therefore, in other words, the toner container 30 as the powder container is mounted in the main body of the image forming apparatus 100 in an indirectly removable manner.

While the toner container 30 in the embodiment is configured to be mounted in the main body of the image forming apparatus 100 in an indirectly removable manner, the toner container 30 may be configured to be mounted in the main body of the image forming apparatus 100 in a directly removable manner.

Furthermore, the process cartridge 10 is the removable member that is detachably attached to the main body of the image forming apparatus 100. However, the developing device may function as the removable member or other devices may function as the removable members. Moreover, the toner container 30 (the powder container) may be configured to be removably mounted in an removable member other than the process cartridge.

Complementary explanation will be given below with reference to FIG. 4 to FIG. 7. The toner container 30 attached to the process cartridge 10 is removably mounted in the main body of the image forming apparatus 100, as a single removable unit (the toner container 30 and the process cartridge 10) as illustrated in FIG. 4. Furthermore, as illustrated in FIG. 5 and FIG. 6, it is possible to attach the toner container 30 to the process cartridge 10 by moving the toner container 30 in a predetermined direction (in the direction of white arrow in FIG. 6), and detach the toner container 30 from the process cartridge 10 by moving the toner container 30 in the opposite direction. The toner container 30 is distributed even in a separate state as illustrated in FIG. 7. Similarly, the process cartridge 10 is distributed even in a separate state.

When the toner container 30 is attached to or detached from the process cartridge 10 (or the main body of the image forming apparatus 100), an operator, such as a user, pulls or pushes the toner container 30 by holding a handle 38 (see FIG. 2 to FIG. 6) disposed on the front side of an operation direction of the toner container 30 (disposed in the +X direction). The handle 38 is provided as a foldable type such that even if the toner container 30 is attached to the main body of the image forming apparatus 100 while the handle 38 is in a standing state (a state illustrated in FIG. 4 to FIG. 6), the handle 38 is pushed by the open/close cover 90 and housed so as to conform to an outer portion of the toner container 30 in conjunction with an operation of shifting the open/close cover 90 from the open state to the closed state.

Meanwhile, as illustrated in FIG. 5 and FIG. 6, a guide 51 and a plurality of positioners 49 and 50 are disposed in the toner container 30, a plurality of guide gutters 77 and 79 and a guide receiver 78 are disposed in the process cartridge 10, and attachment/detachment and positioning of the toner container 30 with respect to the process cartridge 10 are performed while these components are fitted to one another.

Specifically, the toner container 30 is attached to the process cartridge 10 while the two positioners 49 and 50 (the positioning protrusions 49 and 50) that are disposed in a protruding manner on one end side in the width direction of the toner container 30 (in the +Y direction) are respectively guided to the guide receiver 78 and the guide gutter 79 that are disposed on one end side in the width direction of the process cartridge 10, and while the guide 51 (a protrusion formed in an approximately rectangular shape inclined upward in the +X direction), which is disposed on the other end side in the width direction of the toner container 30 (in the −Y direction), is guided to the guide gutter 77 disposed on the other end side in the width direction of the process cartridge 10. In a position in which the positioners 49 and 50 are fitted to tail ends of the guide receiver 78 and the guide gutter 79 and the guide 51 is fitted to a tail end of the guide gutter 77, the position of the toner container 30 in the process cartridge 10 is determined.

Meanwhile, the positioner 49 (a first positioner) is a protrusion disposed in a standing manner so as to surround the circumference of a drive input unit (coupling) for a stirring member that inputs drive from the image forming apparatus to a stirring member 33 that stirs toner (to be described later). Furthermore, the positioner 50 (a second positioner) is a protrusion disposed in a standing manner so as to surround the circumference of a coupling gear 60 serving as a driven unit to be described later. By disposing the input unit that receives drive from the image forming apparatus in the vicinity of (inside) the positioners 49 and 50 as described above, it becomes possible to more reliably input the drive.

The toner container 30 (the powder container) includes the discharge port 36, the collection port 37, a first shutter 40, a second shutter 41, and the like.

With reference to FIG. 2, FIG. 7, and FIG. 9 for example, the discharge port 36 of the toner container 30 is an opening for discharging toner as powder stored in the toner container 30 (the toner storage 31) to the developing device 5. The discharge port 36 communicates with the inflow port 64 of the developing device 5 (an opening disposed above the second developing conveying screw 5*c*) when the toner container 30 is set in the process cartridge 10.

With reference to FIG. 2, FIG. 8, FIG. 10, and FIG. 15 for example, the collection port 37 of the toner container 30 is an opening for receiving and collecting waste toner (untransferred toner) as powder from the outside of the toner container 30. The collection port 37 communicates with the outflow port 74 of the waste toner conveying unit 6 (an opening disposed on the bottom surface of a downstream end of the waste toner conveying unit 6; see FIG. 12 and FIG. 13) when the toner container 30 is set in the process cartridge 10.

With reference to FIG. 2, FIG. 9, and FIG. 10 for example, in the toner container 30 according to the embodiment, the toner storage 31, which serves as the powder storage for storing toner (powder) to be discharged from the discharge port 36, and the waste toner collecting unit 32, which serves as the powder collecting unit for collecting waste toner (powder) received from the collection port 37, are separated by a wall.

Furthermore, in the toner storage 31 (the powder storage), a replenishing screw 34 that is driven to rotate in the clockwise direction in FIG. 2, the stirring member 33 that is driven to rotate in the counterclockwise direction in FIG. 2, and the like are mounted.

The replenishing screw 34 discharges a target amount of toner stored in the toner storage 31 through the discharge port 36 while a driving timing and a rotation time of the replenishing screw 34 are controlled.

The stirring member 33 rotates in a predetermined direction and stirs toner stored in the toner storage 31 to prevent toner cohesion. The stirring member 33 includes two blade portions, which are arranged on a rotary shaft portion so as to deviate by 180 degrees in the rotation direction with respect to the center in a rotation axis direction. Both end portions of the stirring member 33 in the axis direction are rotatably supported by a casing of the toner container 30 via bearings.

A conveying screw 63 (a waste toner conveying screw) driven to rotate in the counterclockwise direction in FIG. 2 is disposed in the waste toner collecting unit 32 (the powder collecting unit). The conveying screw 63 rotates such that the bottommost end thereof moves up toward the upstream side in an insertion direction of the toner container 30. The conveying screw 63 conveys waste toner such that the waste toner flown from the collection port 37 is uniformly collected in the waste toner collecting unit 32 without being accumulated in the vicinity of the collection port 37.

The waste toner collecting unit 32 (the powder collecting unit) includes the coupling gear 60, which serves as the driven unit (a drive input unit) for rotating the conveying screw 63 serving as a first rotary shaft, and includes a driving gear 66 (a drive output unit) for transmitting drive to the waste toner conveying unit 6 (the waste toner conveying coil 6*a*) mounted in the process cartridge 10 by using a driving force of the driven unit, which will be described in detail later.

In the embodiment, when an operator rotates a lever 39 in the state where the toner container 30 is attached to the process cartridge 10 (or the main body of the image forming apparatus 100), an opening/closing operation of the first shutter 40 (the discharge port 36) and an opening/closing operation of the second shutter 41 (the collection port 37) are performed at the same timing, and opening/closing operations of the inflow port 64 and the outflow port 74 of the process cartridge 10 are also performed at the same timing.

The lever 39 is arranged so as to be exposed to the outside as illustrated in FIG. 3B (so as to be operable by an operator) when the open/close cover 90 is opened in the state where the toner container 30 is attached to the main body of the image forming apparatus 100.

Specifically, as illustrated in FIG. 8, a rotary portion 43 that rotates in conjunction with a rotation operation of the lever 39 is disposed in the toner container 30. In the rotary portion 43, a toner container engaging portion 43*a* is disposed that engages with an engaging portion disposed on the process cartridge 10. The toner container engaging portion 43*a* is shaped such that a part of a circle is missing (formed in an approximately circular arc shape). When the toner container 30 is attached to the process cartridge 10, the engaging portion of the process cartridge 10 is inserted in the toner container engaging portion 43*a*. When the lever 39 is rotated in the state where the engaging portion of the process cartridge 10 is inserted, the rotary portion 43 rotates, so that an engaged state with the engaging portion of the process cartridge 10 is obtained. Consequently, engagement of the process cartridge 10 and the toner container 30 is completed, and the toner container 30 is prevented from moving in an extracting direction in which the toner container 30 is extracted from the process cartridge 10.

Furthermore, the engaging portion of the process cartridge 10 rotates with the rotation of the rotary portion 43. Accordingly, a shutter open/close mechanism connected to the engaging portion of the process cartridge 10 moves in a linked manner in a direction in which the second shutter 41 of the toner container 30 is opened, and thus the collection port 37 is opened.

In contrast, when the toner container 30 is detached from the process cartridge 10, the rotary portion 43 rotates in the opposite direction along with a rotation operation of the lever 39 in the opposite direction, so that the second shutter 41 (the collection port 37) is closed and engagement of the toner container engaging portion 43*a* and the engaging portion of the process cartridge 10 is released.

As described above, the rotary portion 43 has a function as an engaging portion for engaging the toner container 30 and the process cartridge 10.

Even if the toner container 30 is attached to the main body of the image forming apparatus 100 while the lever 39 is in the down position (the state illustrated in FIG. 8), the lever 39 is pushed by a pushing member 91 of the open/close cover 90 (see FIG. 3(B)) in conjunction with an operation of closing the open/close cover 90 from the open state, so that an operation of opening the discharge port 36 by the first shutter 40 (and an operation of opening the inflow port 64) and an operation of opening the collection port 37 by the second shutter 41 (and an operation of opening the outflow port 74) are performed simultaneously. Therefore, it is possible to prevent a setting failure.

Furthermore, the pushing member 91 is not fixed to the open/close cover 90 in a standing state (the state illustrated in FIG. 3B), but is disposed as a tiltable type such that a standing state and a fallen state can be switched from one to the other. The pushing member 91 is in the fallen state when shipped from a factory. When the pushing member 91 is in the fallen state, even if the open/close cover 90 is in the closed state, the lever 39 (in the fallen state as illustrated in FIG. 8) is not pushed by the pushing member 91, so that the discharge port 36 and the collection port 37 remain in the closed states. The image forming apparatus 100 is shipped from the factory in such a manner that the toner container 30 is attached thereto while the discharge port 36 and the collection port 37 are closed by the shutters 40 and 41 as described above. Therefore, it is possible to reduce time and effort as compared to a situation in which the main body of the image forming apparatus 100 and the toner container 30 are separately packed and shipped from the factory, and it is also possible to prevent a defect such as toner leakage from the toner container 30 attached to the main body of the image forming apparatus 100 due to vibration or the like during transportation.

At the time of arrival at a user's site or the like, a user (or a service person) performs an operation of rotating the pushing member 91 from the fallen state to the standing state. This operation is performed while the open/close cover 90 is opened (the shutters 40 and 41 remain in the closed states). After the pushing member 91 stands, the shutters 40 and 41 are opened just by closing the open/close cover 90, and toner is supplied from the toner container 30 to the empty developing device 5, so that the developing device 5 becomes ready for use.

With reference to FIG. 11 (and FIG. 12 to FIG. 15), disposed in the waste toner collecting unit 32 (the powder collecting unit) of the toner container 30 (the powder container) according to the embodiment are the collection port 37, the coupling gear 60 as the driven unit, an input unit gear 61, the conveying screw 63 as the first rotary shaft, a first gear 62, a second gear 65, a second rotary shaft 67, the driving gear 66, and the like.

The collection port 37 is, as described above, an opening disposed in the waste toner collecting unit 32 in order to receive and collect waste toner (powder) from outside.

The coupling gear 60 as the driven unit is disposed on one end side (on the right side in FIG. 11) in the width direction of the toner container 30 (the powder container) and receives drive transmitted from outside.

Specifically, the coupling gear 60 includes a coupling portion and a gear portion that are integrated with each other, and is rotatably mounted on a stud that stands on a side surface on the one end side in the width direction of the toner container 30 (a direction corresponding to a rotation axis direction of the conveying screw 63, i.e., a horizontal direction in FIG. 11). When the process cartridge 10 in which the toner container 30 is mounted is attached to the main body of the image forming apparatus 100, the coupling portion of the coupling gear 60 is fitted to a driving coupling disposed in the main body of the image forming apparatus 100 in conjunction with the attachment operation. When a driving motor mounted in the main body of the image forming apparatus 100 is driven and the driving coupling rotates in a predetermined direction, drive is transmitted to the coupling gear 60, so that the coupling gear 60 is driven to rotate in a predetermined direction. In this manner, the coupling gear 60 as the driven unit functions as the drive input unit.

The conveying screw 63 as the first rotary shaft rotates in a predetermined direction by using the drive transmitted to the coupling gear 60 (the driven unit).

Specifically, the conveying screw 63 is a screw member in which a screw portion is spirally wound on a shaft, and is arranged so as to extend across almost the entire length in the width direction of the waste toner collecting unit 32. The conveying screw 63 is rotatably held by a casing of the toner container 30 via a bearing. The conveying screw 63 conveys waste toner such that the waste toner flown from the collection port 37 is uniformly collected in the waste toner collecting unit 32 without being accumulated in the vicinity of the collection port 37. In the embodiment, the screw portion of the conveying screw 63 is not disposed on the downstream side in the conveying direction, which is distant from the collection port 37, in order to take a balance of the waste toner collected by the waste toner collecting unit 32. Furthermore, on one end side in the width direction of the conveying screw 63 (the first rotary shaft), the input unit gear 61 that engages with the gear portion of the coupling gear 60 is disposed. A driving force input to the coupling gear 60 is transmitted to the conveying screw 63 via the input unit gear 61, so that the conveying screw 63 rotates in the predetermined direction together with the input unit gear 61 to thereby convey the waste toner.

The first gear 62 is disposed on the other end side in the width direction of the toner container 30 (on the left side in FIG. 11), and rotates with the conveying screw 63 (the first rotary shaft) and the input unit gear 61. That is, on the conveying screw 63, the input unit gear 61 is disposed on the one end side in the width direction, and the first gear 62 is disposed on the other end side in the width direction. It may be possible to provide an idler gear between the coupling gear 60 and the input unit gear 61.

The second rotary shaft 67 is disposed on the other end side in the width direction of the toner container 30. The second rotary shaft 67 is provided with the second gear 65 to which drive is transmitted from the first gear 62, and rotates with the second gear 65. That is, the second rotary shaft 67 is provided with the second gear 65 that engages with the first gear 62 on the other end side in the width direction, and rotates together with the second gear 65.

Furthermore, the driving gear 66 is disposed on the second rotary shaft 67 in a position distant from the second gear 65 on a central portion side in the width direction. The driving gear 66 is disposed on the second rotary shaft 67 in a position between the second gear 65 and a central portion in the width direction of the toner container 30, and rotates with the second rotary shaft 67 to transmit drive to outside. The driving gear 66 is disposed such that the position in the width direction is located between the collection port 37 and the coupling gear 60 (the driven unit). Specifically, the second rotary shaft 67 is not extended from the other end side in the width direction to the one end side in the width direction unlike the conveying screw 63, but is extended from the other end side in the width direction to the central portion in the width direction in a range shorter than the conveying screw 63. More specifically, the second rotary shaft 67 is disposed so as to be terminated (an end portion is disposed) on the other end side relative to the central portion in the width direction of the toner container 30. Furthermore, a part of the casing of the toner container 30 is formed in a concave shape in order to rotatably hold the second rotary shaft 67 as described above via a bearing. On the second rotary shaft 67, the second gear 65 is disposed on the other end side in the width direction, and the driving gear 66 is disposed in the central portion in the width direction on the one end side in the width direction. A driving force input to the coupling gear 60 is transmitted to the driving gear 66 via the input unit gear 61, the conveying screw 63, the first gear 62, the second gear 65, and the second rotary shaft 67, so that the driving gear 66 rotates in a predetermined direction. The driving gear 66 is disposed between the collection port 37 and the discharge port 36.

It may be possible to provide an idler gear between the first gear 62 and the second gear 65.

The driving gear 66 rotates with the second rotary shaft 67 and the second gear 65 and transmits drive to outside.

Specifically, the driving gear 66 is disposed in the waste toner collecting unit 32 together with the coupling gear 60, the conveying screw 63, the second rotary shaft 67, and the plurality of gears 61, 62, and 65, and drives the waste toner conveying coil 6*a* serving as a conveying member that conveys untransferred toner stored in the cleaning device 2 mounted in the process cartridge 10 toward the collection port 37. In this manner, the driving gear 66 functions as the drive output unit that transmits a driving force to the externally-provided waste toner conveying coil 6*a* by using a driving force that is input to the coupling gear 60 from outside.

More specifically, with reference to FIG. 11, a driven coupling 80 including a gear portion is disposed on one end side in the width direction of the photoconductor drum 1 of the process cartridge 10. When the process cartridge 10 is attached to the main body of the image forming apparatus 100, the driven coupling 80 is fitted to a driving coupling disposed in the main body of the image forming apparatus 100 in conjunction with the attachment operation. When a driving motor mounted in the main body of the image forming apparatus 100 is driven and the driving coupling rotates in a predetermined direction, drive is transmitted to the driven coupling 80, so that the driven coupling 80 is driven to rotate in a predetermined direction (in the clockwise direction in FIG. 1).

Meanwhile, a gear 81 that engages with the gear portion of the driven coupling 80 of the photoconductor drum 1 is disposed on the one end side in the width direction of the collecting screw 2*b* disposed inside the cleaning device 2. The collecting screw 2*b* rotates in a predetermined direction along with the rotation drive of the photoconductor drum 1 as described above, so that untransferred toner collected by the cleaning device 2 is conveyed from the one end side in the width direction to the other end side in the width direction in the direction of dashed line arrow. The untransferred toner conveyed to the other end side in the width direction by the collecting screw 2*b* is fed into the waste toner conveying unit 6, is conveyed to the position of the outflow port 74 by the waste toner conveying coil 6*a* (the conveying member) disposed in the waste toner conveying unit 6, and is collected, as waste toner, in the waste toner collecting unit 32 (the toner container 30) through the collection port 37.

As described above, the untransferred toner (the waste toner) collected by the cleaning device 2 in the process cartridge 10 moves as indicated by the dashed line arrow in FIG. 11, and is finally collected in the waste toner collecting unit 32 (the toner container 30) through the collection port 37.

A driven gear 75 that engages with the driving gear 66 of the waste toner collecting unit 32 is disposed on one end side (an end portion on the outflow port 74 side or the downstream side in a conveying direction of the waste toner) of the waste toner conveying coil 6*a* (the conveying member). The driven gear 75 engages with the driving gear 66 in conjunction with the attachment operation of the toner container 30 with respect to the process cartridge 10. As described above, when drive is transmitted from the driving gear 66 of the waste toner collecting unit 32 to the driven gear 75, and the waste toner conveying coil 6*a* (the conveying member) rotates in a predetermined direction, the waste toner (the untransferred toner) in the waste toner conveying unit 6 is conveyed toward the position of the outflow port 74. As illustrated in FIG. 13 for example, the waste toner conveying unit 6 according to the embodiment conveys the waste toner from a joint portion of the cleaning device 2 to an oblique upper side and then conveys the waste toner in an approximately horizontal direction from the other end side in the width direction to the central portion in the width direction, that is, the waste toner conveying unit 6 includes a curved conveying portion. The waste toner conveying coil 6*a* is flexibly bendable, so that even if the waste toner conveying coil 6*a* is mounted inside the waste toner conveying unit 6 having the curved conveying portion as described above, it is possible to convey the waste toner in a preferred manner.

The driven gear 75 is disposed on a tail end of the waste toner conveying coil 6*a* in a position beyond the outflow port 74 in a flowing direction of the waste toner. In other words, the driven gear 75 is arranged in a tail end portion of a waste toner conveying path. With this arrangement, it becomes possible to receive drive from the driving gear 66 in a position in which conveyance of the waste toner is not disturbed. Furthermore, it is possible to effectively use a space.

Moreover, the rotary shaft (the second rotary shaft 67) of the driving gear 66 is located below a rotary shaft of the driven gear 75. The rotation direction of the driving gear 66 is a direction in which the driven gear 75 is scooped up (a direction in which the bottommost point moves up toward the driven gear 75, i.e., a direction in which the bottommost point moves toward the downstream side in the insertion direction of the toner container 30). With this configuration, the toner container 30 is pressed downward and the posture of the toner container 30 with respect to the process cartridge 10 is stabilized.

As described above, in the embodiment, the waste toner conveying coil 6*a* is driven by the drive transmission from the driving gear 66 of the waste toner collecting unit 32 in a position of the central portion in the width direction, instead of separately providing a drive source of the waste toner conveying coil 6*a* or instead of driving the waste toner conveying coil 6*a* by the drive transmission by the collecting screw 2*b* at the joint portion of the cleaning device 2.

In other words, the toner container 30 (the powder container) according to the embodiment includes the driven unit (the coupling gear 60) disposed on the one end side, the driving gear 66 disposed between the one end side and the other end side, a first transmitting unit that transmits a driving force input to the driven unit to the other end side, and a second transmitting unit that transmits a driving force transmitted to the first transmitting unit to the driving gear 66.

Therefore, it is possible to relatively simplify the configuration of a driving mechanism of the waste toner conveying coil 6*a*, and reduce a defect such as an increase in the size of the process cartridge 10 due to the driving mechanism of the waste toner conveying coil 6*a*.

Furthermore, the toner container 30 (the powder container) according to the embodiment includes the coupling gear 60, which serves as the driven unit (the drive input unit) for driving the conveying screw 63 for conveying the internally-collected waste toner and which is disposed on the one end side in the width direction, and includes the driving gear 66 (the drive output unit), which transmits drive to the externally-provided waste toner conveying unit 6 (the waste toner conveying coil 6*a*) by using the driving force of the coupling gear 60. In this regard, the driving gear 66 is arranged in the central portion in the width direction instead of being arranged on the other end side in the width direction. Therefore, it is possible to reduce a defect such as an increase in the size of the toner container 30 in the width direction.

Moreover, in the embodiment, the toner container 30 including the waste toner collecting unit 32 is configured to be removably mounted in the process cartridge 10. In this regard, even if the process cartridge 10 to which the toner container 30 is attached is handled as a single removable unit, the entire size is reduced.

In the embodiment, as illustrated in FIG. 15 for example, the collection port 37 is arranged above the conveying screw 63 (the first rotary shaft). Specifically, the collection port 37 is arranged right above the screw portion of the conveying screw 63.

With this arrangement, the waste toner flown from the collection port 37 falls by gravity and hits against the rotating conveying screw 63, so that the waste toner is loosened. Therefore, the collection efficiency of the waste toner in the waste toner collecting unit 32 is improved.

Meanwhile, the collection port 37 is an opening portion that communicates with the outflow port 74 of the process cartridge 10. A collection path in the form of a square pole extends from the collection port 37 toward the toner container 30. An opening of the collection path (a collection path opening) on the toner container 30 side is opened above the conveying screw 63 (the first rotary shaft). The waste toner flown from the collection port 37 falls on the conveying screw 63 through the collection path. In other words, the collection path is disposed in a position in which the waste toner falls on the conveying screw 63.

Furthermore, in the embodiment, as illustrated in FIG. 11 and FIG. 15 for example, the collection port 37 is arranged such that the position in the width direction is located between the second gear 65 and the driving gear 66.

Therefore, it is possible to arrange the collection port 37 by effectively using a space between the second gear 65 and the driving gear 66, so that the entire toner container 30 can be made compact.

Moreover, with reference to FIG. 11, the collection port 37 is disposed such that a distance B between an end portion of gear teeth of the second gear 65 on the one end side and an edge of the collection port 37 on the other end side is shorter than a distance A between an end portion of gear teeth of the driving gear 66 on the one end side and an edge of the collection port 37 on the one end side (A>B). With this configuration, it is possible to efficiently convey the waste toner.

Furthermore, in the embodiment, as illustrated in FIG. 14 for example, the center of rotation of the second rotary shaft 67 is located on the upper side of the center of rotation of the conveying screw 63 (the first rotary shaft).

Therefore, it is possible to easily arrange the collection port 37 on the upper side of the conveying screw 63, so that the above-described effects (the effect of improving the collection efficiency of the waste toner in the waste toner collecting unit 32 and the effect of making the toner container 30 compact) can more easily be obtained.

Moreover, in the embodiment, as illustrated in FIG. 12 for example, the center of rotation of the second rotary shaft 67 is located on the lower side of the center of rotation of the driven gear 75 (the driven gear that is disposed in the process cartridge 10 and engages with the driving gear 66).

Therefore, the position of the toner container 30 can easily be determined by an external force that acts on the coupling gear 60 serving as the drive input unit and a force that acts on the driving gear 66 serving as the drive output unit (a reaction force applied from the driven gear 75).

Furthermore, in the embodiment, as illustrated in FIG. 6 for example, the driving gear 66 is arranged so as to be exposed to the outside of the toner container 30 (in the separate state). Moreover, as illustrated in FIG. 5 for example, the driven gear 75 is arranged so as to be exposed to the outside of the process cartridge 10 (in the separate state). Therefore, it is possible to engage and disengage the driven gear 75 of the process cartridge 10 and the driving gear 66 of the toner container 30 in conjunction with the attachment/detachment operation of the toner container 30 with respect to the process cartridge 10.

Furthermore, as illustrated in FIG. 8, a guide protrusion 69 is disposed on the side surface of the toner container 30 so as to protrude toward the other end side of the toner container 30. The guide protrusion 69 guides the toner container 30 by sliding on a sliding portion disposed on the process cartridge 10 when the toner container 30 is attached to the process cartridge 10.

Moreover, in the embodiment, with reference to FIG. 6 and FIG. 8 for example, the guide 51 (an insertion protrusion) that is guided along the guide gutter 77 (see FIG. 5) at the time of attachment of the toner container 30 to the process cartridge 10 is disposed on the other end side in the width direction (on the side where the second gear 65, the driving gear 66, and the second rotary shaft 67 are disposed).

Therefore, the toner container 30 can smoothly be attached to the process cartridge 10 and an engagement failure between the driving gear 66 and the driven gear 75 is less likely to occur.

Specifically, the guide 51 is a protrusion protruding from the end portion on the other end side of the toner container 30, and formed in a shape having a long shaft inclined downward to a rear side (the downstream side in the insertion direction of the toner container 30) when the toner container 30 is attached to the process cartridge 10. That is, the guide 51 is a protrusion extended and inclined toward the rear side.

Furthermore, an end portion on the bottommost side of the inclination of the guide 51 is formed in a circular arc shape and is slightly greater in size than other portions (expanded). The slightly greater portion is inserted in and guided by the guide gutter 77 (a groove inclined in the same manner as the guide 51) when the toner container 30 is inserted in the process cartridge 10. The other portions of the guide 51 are linearly inclined and have a function to prevent a backlash around the bottommost end portion after insertion in the guide gutter 77.

The driving gear 66 is disposed on the upper side of the guide 51. The toner container 30 is inserted while upward movement of the guide 51 is restricted by the guide gutter 77 on the lower side of the driving gear 66. Therefore, the driving gear 66 can easily engage with the lower part of the driven gear 75 of the process cartridge 10.

Furthermore, the rotary portion 43 (the toner container engaging portion 43*a*) described above with reference to FIG. 8 is disposed on the upper side of the driving gear 66. That is, the driving gear 66 is located between the guide 51 and the rotary portion 43 in the vertical direction. In the embodiment, the rotary portion 43 is located on the upper side of the driving gear 66 and the guide 51 is located on the lower side of the driving gear 66. With this configuration, it is possible to further prevent a backlash of the driving gear 66.

In the embodiment, the driving gear 66 is configured to have allowances in the rotation direction in order to further prevent an engagement failure between the driving gear 66 and the driven gear 75 when the toner container 30 is attached to the process cartridge 10.

Specifically, as illustrated in FIG. 16A, the driving gear 66 is disposed on the second rotary shaft 67 via a fitting member 68. The fitting member 68 includes three protruding portions 68*a* disposed at regular intervals in the rotation direction, and is mounted so as to be fitted to a D-cut portion disposed on the end portion on the other end side in the width direction of the second rotary shaft 67. Meanwhile, as illustrated in FIG. 16B, three recessed portions 66*a* are disposed at regular intervals in the rotation direction on an opposing surface of the driving gear 66 (a surface that faces the fitting member 68). The widths of the recessed portions 66*a* of the driving gear 66 in the circumferential direction are slightly wider than the widths of the protruding portions 68*a* of the fitting member 68 in the circumferential direction. With this configuration, while the driving gear 66 fitted to the fitting member 68 rotates with the second rotary shaft 67, the driving gear 66 has allowances in the rotation direction corresponding to gaps between the protruding portions 68*a* and the recessed portions 66*a*.

With the allowances of the driving gear 66 in the rotation direction as described above, even if the edges of the teeth of the driving gear 66 and the driven gear 75 nearly come into contact with each other when the toner container 30 is attached to the process cartridge 10, the driving gear 66 rotates in the rotation direction because of the allowances. Therefore, it is possible to prevent a defect such as damage of the edges of the teeth.

Meanwhile, movement of the driving gear 66 in an axis direction on the second rotary shaft 67 is restricted by a stopper ring so that the driving gear 66 fitted to the fitting member 68 with the allowances in the rotation direction can be prevented from coming off from the second rotary shaft 67.

Furthermore, the allowances of the driving gear 66 in the rotation direction causes a slight delay in the start of the rotation of the driving gear 66 when the second rotary shaft 67 starts to rotate; however, such a delay does not much influence the drive of the waste toner conveying coil 6*a*.

As described above, the toner container 30 (the powder container) according to the embodiment includes the collection port 37 for receiving and collecting waste toner (powder) from outside, the coupling gear 60 (the driven unit) to which drive transmitted from outside on one end side in the width direction of the toner container 30, the conveying screw 63 (the first rotary shaft) that rotates by using the drive transmitted to the coupling gear 60, the first gear 62 that rotates with the conveying screw 63 on the other end side in the width direction of the toner container 30, the second rotary shaft 67 that rotates with the second gear 65 to which drive is transmitted from the first gear 62 on the other end side in the width direction of the toner container 30, and the driving gear 66 that is disposed on the second rotary shaft 67 in a position between the second gear 65 and the central portion in the width direction of the toner container 30 and that rotates with the second rotary shaft 67 to transmit drive to outside.

With this configuration, it is possible to provide the coupling gear 60 serving as the drive input unit and the driving gear 66 serving as the drive output unit without much increase in the size of the toner container 30.

In the embodiment, the present invention is applied to the process cartridge 10 in which the photoconductor drum 1 (an image bearer), the charging roller 4 (a charging device), the developing device 5, the cleaning device 2, and the waste toner conveying unit 6 are integrated. However, the present invention is not limited to the embodiment, and may of course be applied to a configuration in which each of the devices 1, 2, and 4 to 6 is constructed as a unit to be separately attached to and detached from the main body of the image forming apparatus 100.

Even in this case, it is possible to obtain the same effects as described in the embodiment.

In the present application, the "process cartridge" is an removable member (a removable unit), in which at least one of the charging device for charging the image bearer, the developing device for developing a latent image formed on the image bearer, and the cleaning device for cleaning the image bearer is integrated with the image bearer, and which is removably mounted in the main body of the image forming apparatus.

Furthermore, in the embodiment, the present invention is applied to the toner container 30 (the powder container) mounted in the monochrome image forming apparatus 100. However, the present invention may of course be applied to a toner container (a powder container) mounted in a color image forming apparatus.

Moreover, in the embodiment, the present invention is applied to the toner container 30 (the powder container) that is mounted in the main body of the image forming apparatus 100 in an indirectly removable manner via the process cartridge 10. However, the present invention may be applied to a toner container (a powder container) that is mounted in the main body of the image forming apparatus in a directly removable manner without via the process cartridge.

Furthermore, in the embodiment, the present invention is applied to the toner container 30 (the powder container) in which toner (one-component developer) as powder is stored and collected. However, the present invention may be applied to a powder container in which two-component developer (developer in which toner and carrier are mixed) as powder is stored and collected.

Moreover, in the embodiment, drive is transmitted from the coupling gear 60 serving as the driven unit to the conveying screw 63 (the first rotary shaft) via the input unit gear 61. However, it may be possible to directly transmit drive from the driven unit to the first rotary shaft.

Furthermore, in the embodiment, the present invention is applied to the toner container 30 (the powder container) in which the toner storage 31 and the waste toner collecting unit 32 are integrated with each other. However, the present invention may of course be applied to a powder container that includes only the waste toner collecting unit (the powder collecting unit).

Moreover, in the embodiment, it may be possible to use a drive source of the drive input unit for the stirring member as a drive source of the drive input unit (the coupling gear 60) in the toner container 30.

Even in the cases as described above, it is possible to obtain the same effects as described in the embodiment.

Note that the present invention is not limited to the above-described embodiment, and the embodiment may be appropriately modified within the scope of the technical idea of the present invention even in a manner other than those indicated in the embodiment. Furthermore, numbers, positions, shapes, etc. of the above-described components are not limited to those described in the embodiment, and may be changed to other numbers, positions, and shapes that are appropriate to embody the present invention.

In the present description and the like, the "powder container" is a container for storing powder that is to be used in the image forming apparatus or powder that has been used in the image forming apparatus. Therefore, the "powder container" includes a container for storing new toner or new carrier and a container for storing used toner or used carrier.

Furthermore, in the present description and the like, the "width direction" is a direction perpendicular to the direction in which the powder container is attached to the process cartridge. The powder container has a longitudinal side and a short side, and the "width direction" corresponds to the longitudinal direction of the powder container. In addition, the "width direction" is the same as the direction in which the shaft of the conveying screw extends.

Moreover, in the present description and the like, the "one end side in the width direction" is one end side based on the assumption that one side serves as one end side and the other side serves as the other end side when the subject component is divided at the central portion in the longitudinal direction. In addition, the "end portion on the one end side" is an end portion on the "one end side in the width direction", that is, an end portion in the longitudinal direction. In the embodiment, the driven unit is disposed on the end portion on the one end side.

Furthermore, in the present description and the like, the "other end side in the width direction" is the other end side based on the assumption that one side serves as one end side and the other side serves as the other end side when the subject component is divided at the central portion in the longitudinal direction. In addition, the "end portion on the other end side" is an end portion on the "other end side in the width direction", that is, an end portion in the longitudinal direction.

Moreover, in the present description and the like, the "central portion in the width direction" is a portion located in the center between the "end portion on the one end side" and the "end portion on the other end side". The central portion in the width direction of the powder container indicates the middle in the longitudinal direction of the powder container.

(Aspect 1)

A powder container that is removably mounted in one of a main body of an image forming apparatus and a removable member that is removably mounted in the main body of the image forming apparatus, the powder container comprising:

a collection port to receive and collect powder from outside;

a driven unit that is disposed on one end side in a longitudinal direction of the powder container and to which drive is transmitted from outside;

a first rotary shaft that rotates by using the drive transmitted to the driven unit;

a first gear that is disposed on other end side in the longitudinal direction of the powder container and that rotates with the first rotary shaft;

a second rotary shaft that is disposed on the other end side in the longitudinal direction of the powder container, that includes a second gear to which drive is transmitted from the first gear, and that rotates with the second gear; and a driving gear that is disposed on the second rotary shaft in a position between the second gear and a central portion in the longitudinal direction of the powder container, and that rotates with the second rotary shaft to transmit drive to outside.

(Aspect 2)

The powder container according to aspect 1, wherein the first rotary shaft is a conveying screw including a shaft and a screw portion spirally wound on the shaft.

(Aspect 3)

The powder container according to aspect 2, wherein the collection port is disposed right above the screw portion of the conveying screw.

(Aspect 4)

The powder container according to any one of aspects 1 to 3, wherein the collection port is disposed above the first rotary shaft.

(Aspect 5)

The powder container according to any one of aspects 1 to 4, wherein the collection port is disposed such that a position in the longitudinal direction is located between the second gear and the driving gear.

(Aspect 6)

The powder container according to any one of aspects 1 to 5, wherein a center of rotation of the second rotary shaft is located on an upper side of a center of rotation of the first rotary shaft.

(Aspect 7)

The powder container according to any one of aspects 1 to 6, wherein the driving gear is disposed so as to be exposed to outside of the powder container.

(Aspect 8)

The powder container according to any one of aspects 1 to 7, wherein a center of rotation of the second rotary shaft is located on a lower side of a center of rotation of a driven gear that is disposed in one of the main body of the image forming apparatus and the removable member and that engages with the driving gear.

(Aspect 9)

The powder container according to any one of aspects 1 to 8, further comprising a guide that is disposed on the other end side in the longitudinal direction and that is guided when the powder container is attached to one of the main body of the image forming apparatus and the removable member.

(Aspect 10)

The powder container according to any one of aspects 1 to 9, further comprising:

a powder collecting unit that collects powder received from the collection port; and a powder storage that discharges powder stored therein from a discharge port, wherein the powder collecting unit and the powder storage are separated by a wall, and the driving gear is disposed in the powder collecting unit and drives a conveying member that conveys untransferred toner stored in a cleaning device mounted in one of the main body of the image forming apparatus and the removable member toward the collection port.

(Aspect 11)

A powder container that is removably mounted in one of a main body of an image forming apparatus and an removable member that is removably mounted in the main body of the image forming apparatus, the powder container comprising:

a collection port to receive and collect powder from outside;

a driven unit that is disposed on one end side in a longitudinal direction of the powder container and to which drive is transmitted from outside; and a driving gear that is disposed such that a position in the longitudinal direction is located between the collection port and the driven unit and that transmits drive to outside.

(Aspect 12)

A powder container comprising:

a driven unit disposed on one end side of the powder container;

a driving gear disposed between the one end side and other end side;

a first transmitting unit that transmits a driving force input to the driven unit to the other end side; and a second transmitting unit that transmits the driving force transmitted to the first transmitting unit to the driving gear.

(Aspect 13)

A process cartridge that is removably mounted in the main body of the image forming apparatus, the process cartridge comprising the powder container according to any one of aspects 1 to 12.

(Aspect 14)

An image forming apparatus comprising the powder container according to any one of aspects 1 to 12.

(Aspect 15)

A powder container that is removably mounted in one of a main body of an image forming apparatus and a removable member that is removably mounted in the main body of the image forming apparatus, the powder container comprising:

a collection port to receive powder from outside;

a driven unit that is disposed on one end side in a longitudinal direction of the powder container and to which drive is transmitted from outside;

a first rotary shaft that rotates by using the drive transmitted to the driven unit;

a first gear that is disposed on other end side in the longitudinal direction of the powder container and that rotates with the first rotary shaft;

a second gear that is disposed on the other end side in the longitudinal direction of the powder container and to which drive is transmitted from the first gear;

a second rotary shaft on which the second gear is disposed and that rotates with the second gear; and a driving gear that is disposed on the second rotary shaft in a position between the second gear and a central portion in the longitudinal direction of the powder container, and that rotates with the second rotary shaft to transmit drive to outside.

(Aspect 16)

The powder container according to aspect 15, wherein the first rotary shaft is a conveying screw including a shaft and a screw portion spirally wound on the shaft.

(Aspect 17)

The powder container according to aspect 16, wherein the collection port is disposed right above the screw portion of the conveying screw.

(Aspect 18)

The powder container according to any one of aspects 15 to 17, wherein the collection port is disposed above the first rotary shaft.

(Aspect 19)

The powder container according to any one of aspects 15 to 18, wherein the collection port is disposed such that a position in the longitudinal direction is located between the second gear and the driving gear.

(Aspect 20)

The powder container according to any one of aspects 15 to 19, wherein a center of rotation of the second rotary shaft is located on an upper side of a center of rotation of the first rotary shaft.

(Aspect 21)

The powder container according to any one of aspects 15 to 20, wherein the driving gear is disposed so as to be exposed to outside of the powder container.

(Aspect 22)

The powder container according to any one of aspects 15 to 21, wherein a center of rotation of the second rotary shaft is located on a lower side of a center of rotation of a driven gear that is disposed in one of the main body of the image forming apparatus and the removable member and that engages with the driving gear.

(Aspect 23)

The powder container according to any one of aspects 15 to 22, further comprising a guide that is disposed on the other end side in the longitudinal direction and that is guided when the powder container is attached to one of the main body of the image forming apparatus and the removable member.

(Aspect 24)

The powder container according to any one of aspects 15 to 23, further comprising:

a powder collecting unit that collects powder received from the collection port; and a powder storage that discharges powder stored therein from a discharge port, wherein the powder collecting unit and the powder storage are separated by a wall, and the driving gear is disposed in the powder collecting unit and drives a conveying member that conveys untransferred toner stored in a cleaning device mounted in one of the main body of the image forming apparatus and the removable member toward the collection port.

(Aspect 25)

A process cartridge that is removably mounted in the main body of the image forming apparatus, the process cartridge comprising the powder container according to any one of aspects 15 to 24.

(Aspect 26)

An image forming apparatus comprising the powder container according to any one of aspects 15 to 24.

REFERENCE SIGNS LIST

1 Photoconductor drum (image bearer)
2 Cleaning device
2*b* Collecting screw
5 Developing device
6 Waste toner conveying unit
6*a* Waste toner conveying coil (conveying member)
10 Process cartridge
30 Toner container (powder container)
31 Toner storage (powder storage)
32 Waste toner collecting unit (powder collecting unit)
36 Discharge port
37 Collection port
51 Guide
60 Coupling gear (driven unit)
61 Input unit gear
62 First gear
63 Conveying screw (first rotary shaft)
64 Inflow port
65 Second gear
66 Driving gear
66*a* Recessed portion
67 Second rotary shaft
68 Fitting member
68*a* Protruding portion
74 Outflow port
75 Driven gear
100 Image forming apparatus (main body of image forming apparatus)

CITATION LIST

Patent Literature

PTL 1: Japanese Unexamined Patent Application Publication No. 2009-80433

The invention claimed is:

1. A powder container that is removably mounted in one of a main body of an image forming apparatus and a removable member that is removably mounted in the main body of the image forming apparatus, the powder container comprising:

a collection port to receive and collect powder from outside;

a driven unit that is disposed on one end side in a longitudinal direction of the powder container and to which drive is transmitted from outside;

a first rotary shaft that rotates by using the drive transmitted to the driven unit;

a first gear that is disposed on other end side in the longitudinal direction of the powder container and that rotates with the first rotary shaft;

a second rotary shaft that is disposed on the other end side in the longitudinal direction of the powder container, that includes a second gear to which drive is transmitted from the first gear, and that rotates with the second gear; and a driving gear that is disposed on the second rotary shaft in a position between the second gear and a central portion in the longitudinal direction of the powder container, and that rotates with the second rotary shaft to transmit drive to outside.

2. The powder container according to claim 1, wherein the first rotary shaft is a conveying screw including a shaft and a screw portion spirally wound on the shaft.

3. The powder container according to claim 2, wherein the collection port is disposed right above the screw portion of the conveying screw.

4. The powder container according to claim 1, wherein the collection port is disposed above the first rotary shaft.

5. The powder container according to claim 1, wherein the collection port is disposed such that a position in the longitudinal direction is located between the second gear and the driving gear.

6. The powder container according to claim 1, wherein a center of rotation of the second rotary shaft is located on an upper side of a center of rotation of the first rotary shaft.

7. The powder container according to claim 1, wherein the driving gear is disposed so as to be exposed to outside of the powder container.

8. The powder container according to claim 1, wherein a center of rotation of the second rotary shaft is located on a lower side of a center of rotation of a driven gear that is disposed in one of the main body of the image forming apparatus and the removable member and that engages with the driving gear.

9. The powder container according to claim 1, further comprising a guide that is disposed on the other end side in the longitudinal direction and that is guided when the powder container is attached to one of the main body of the image forming apparatus and the removable member.

10. The powder container according to claim 1, further comprising:

a powder collecting unit that collects powder received from the collection port; and a powder storage that discharges powder stored therein from a discharge port, wherein the powder collecting unit and the powder storage are separated by a wall, and the driving gear is disposed in the powder collecting unit and drives a conveying member that conveys untransferred toner stored in a cleaning device mounted in one of the main body of the image forming apparatus and the removable member toward the collection port.

11. A process cartridge that is removably mounted in the main body of the image forming apparatus, the process cartridge comprising the powder container according to claim 1.

12. An image forming apparatus comprising the powder container according to claim 1.

13. The powder container of claim 1, further comprising a discharge port to discharge powder contained in the powder container, the discharge port being arranged on the one end side.

14. A powder container comprising:

a driven unit disposed on one end side of the powder container;

a driving gear disposed between the one end side and other end side;

a first transmitting unit that transmits a driving force input to the driven unit to the other end side; and a second transmitting unit that transmits the driving force transmitted to the first transmitting unit to the driving gear.

15. The powder container of claim 14, further comprising a discharge port to discharge powder contained in the powder container, the discharge port being arranged on the one end side.

16. A powder container that is removably mounted in one of a main body of an image forming apparatus and a removable member that is removably mounted in the main body of the image forming apparatus, the powder container comprising:

a collection port to receive powder from outside;

a driven unit that is disposed on one end side in a longitudinal direction of the powder container and to which drive is transmitted from outside;

a first rotary shaft that rotates by using the drive transmitted to the driven unit;

a first gear that is disposed on other end side in the longitudinal direction of the powder container and that rotates with the first rotary shaft;

a second gear that is disposed on the other end side in the longitudinal direction of the powder container and to which drive is transmitted from the first gear;

a second rotary shaft on which the second gear is disposed and that rotates with the second gear; and a driving gear that is disposed on the second rotary shaft in a position between the second gear and a central portion in the longitudinal direction of the powder container, and that rotates with the second rotary shaft to transmit drive to outside.

17. The powder container according to claim 16, wherein the first rotary shaft is a conveying screw including a shaft and a screw portion spirally wound on the shaft.

18. The powder container according to claim 17, wherein the collection port is disposed right above the screw portion of the conveying screw.

19. The powder container according to claim 16, wherein the collection port is disposed above the first rotary shaft.

20. The powder container according to claim 16, wherein the collection port is disposed such that a position in the longitudinal direction is located between the second gear and the driving gear.

21. The powder container according to claim 16, wherein a center of rotation of the second rotary shaft is located on an upper side of a center of rotation of the first rotary shaft.

22. The powder container according to claim 16, wherein the driving gear is disposed so as to be exposed to outside of the powder container.

23. The powder container according to claim 16, wherein a center of rotation of the second rotary shaft is located on a lower side of a center of rotation of a driven gear that is disposed in one of the main body of the image forming apparatus and the removable member and that engages with the driving gear.

24. The powder container according to claim 16, further comprising a guide that is disposed on the other end side in the longitudinal direction and that is guided when the powder container is attached to one of the main body of the image forming apparatus and the removable member.

25. The powder container according to claim 16, further comprising:

a powder collecting unit that collects powder received from the collection port; and a powder storage that discharges powder stored therein from a discharge port, wherein the powder collecting unit and the powder storage are separated by a wall, and the driving gear is disposed in the powder collecting unit and drives a conveying member that conveys untransferred toner stored in a cleaning device mounted in one of the main body of the image forming apparatus and the removable member toward the collection port.

26. A process cartridge that is removably mounted in the main body of the image forming apparatus, the process cartridge comprising the powder container according to claim 16.

27. An image forming apparatus comprising the powder container according to claim 16.

28. The powder container of claim 16, further comprising a discharge port to discharge powder contained in the powder container, the discharge port being arranged on the one end side.

* * * * *